US008108954B2

(12) United States Patent
Lau

(10) Patent No.: US 8,108,954 B2
(45) **Date of Patent: *Feb. 7, 2012**

(54) PORTABLE SPA

(75) Inventor: Vincent W. S. Lau, Hong Kong (HK)

(73) Assignee: Ideal Time Consultants Limited, Tortola (VG)

( * ) Notice: Subject to any disclaimer, the term of this patent is extended or adjusted under 35 U.S.C. 154(b) by 14 days.

This patent is subject to a terminal disclaimer.

(21) Appl. No.: 12/924,098

(22) Filed: Sep. 20, 2010

(65) Prior Publication Data

US 2011/0010836 A1 Jan. 20, 2011

Related U.S. Application Data

(63) Continuation-in-part of application No. 11/700,218, filed on Jan. 30, 2007, which is a continuation-in-part of application No. 11/412,541, filed on Apr. 27, 2006, now Pat. No. 7,818,825, which is a continuation-in-part of application No. 11/136,280, filed on May 23, 2005, now abandoned.

(51) Int. Cl.
*A47K 3/00* (2006.01)

(52) U.S. Cl. ..... 4/541.1; 4/541.5

(58) Field of Classification Search ..... 4/541.1–541.6
See application file for complete search history.

(56) References Cited

U.S. PATENT DOCUMENTS

| | | | |
|---|---|---|---|
| 2,856,611 | A | 10/1958 | Velonis |
| 3,391,870 | A | 7/1968 | Nash |
| 3,452,370 | A | 7/1969 | Jacuzzi |
| 3,596,296 | A | 8/1971 | Gertz |
| 4,233,694 | A | 11/1980 | Janosko et al. |
| 4,535,490 | A | 8/1985 | Wright |
| 4,546,505 | A | 10/1985 | Wakenshaw |
| 4,599,753 | A | 7/1986 | Goodman |
| 4,607,400 | A | 8/1986 | Goodman et al. |
| 4,625,715 | A | 12/1986 | Bucher |
| 4,744,112 | A | 5/1988 | Keesling, Jr. |
| 4,749,477 | A | 6/1988 | McGregor |
| 4,773,104 | A | 9/1988 | Wang |
| 4,801,378 | A | 1/1989 | Desjoyaux et al. |
| 4,853,987 | A | 8/1989 | Jaworski |
| 4,893,362 | A | 1/1990 | Murphy |
| 4,975,992 | A | 12/1990 | Patterson et al. |
| 5,056,168 | A | 10/1991 | Mersmann |
| 5,199,116 | A | 4/1993 | Fischer et al. |
| 5,307,529 | A | 5/1994 | Wang et al. |
| 5,345,622 | A | 9/1994 | Plone |
| 5,386,598 | A | 2/1995 | Mersmann et al. |
| 5,597,288 | A | 1/1997 | Hatanaka |

(Continued)

FOREIGN PATENT DOCUMENTS

| | | |
|---|---|---|
| DE | 2209507 | 9/1973 |
| DE | 2 313 326 | 9/1974 |
| DE | 2931182 | 2/1981 |

(Continued)

*Primary Examiner* — Gregory Huson
*Assistant Examiner* — Karen L Younkins
(74) *Attorney, Agent, or Firm* — Raymond Sun

(57) ABSTRACT

A spa pool assembly has a pool having an enclosing wall and a base that together defines an interior. The base has a plurality of inflatable sections that are divided by a plurality of air passages that includes a first air passage that has a plurality of small bubble openings, and a second air passage that has a plurality of large bubble openings. The small bubble openings eject bubbles that are smaller in size than the bubbles ejected from the large bubble openings. The spa pool assembly can also include a bubble controller that controls the ejection of bubbles from the small bubble openings and the large bubble openings.

12 Claims, 22 Drawing Sheets

U.S. PATENT DOCUMENTS

| | | | |
|---|---|---|---|
| 5,862,543 | A | 1/1999 | Reynoso et al. |
| 5,930,851 | A | 8/1999 | Brunelle |
| 5,983,416 | A | 11/1999 | Idland |
| 6,108,829 | A | 8/2000 | Wadsworth et al. |
| 6,357,059 | B1 | 3/2002 | Lau |
| 6,412,123 | B1 | 7/2002 | Lau |
| 6,752,773 | B2 | 6/2004 | Leung et al. |
| 2002/0029414 | A1 | 3/2002 | Lau |
| 2004/0261172 | A1 | 12/2004 | Leung et al. |
| 2006/0288479 | A1 | 12/2006 | Chang |

FOREIGN PATENT DOCUMENTS

| | | |
|---|---|---|
| DE | 29 40 863 | 4/1981 |
| DE | 30 37 750 | 5/1982 |
| EP | 0 376 843 | 7/1990 |
| EP | 1 219 280 | 7/2002 |
| EP | 1 354 578 | 10/2003 |
| EP | 1 726 283 | 11/2006 |
| IT | 532405 | 4/1958 |
| JP | 6-90873 | 4/1994 |
| NL | 8 802 541 | 8/1989 |
| WO | WO-89/01620 | 7/1989 |
| WO | WO 03/088890 | 10/2003 |

PORTABLE SPA

RELATED CASES

This is a continuation-in-part of Ser. No. 11/700,218, filed Jan. 30, 2007, which is a continuation-in-part of Ser. No. 11/412,541, filed Apr. 27, 2006 now U.S. Pat. No. 7,818,825, which is a continuation-in-part of Ser. No. 11/136,280, filed May 23, 2005 now abandoned, whose entire disclosures are incorporated by this reference as though set forth fully herein.

BACKGROUND OF THE INVENTION

1. Field of the Invention

The present invention relates to portable pools, and in particular, to a portable spa pool that can be conveniently moved from one location to another, and which can be conveniently and quickly installed and disassembled.

2. Description of the Prior Art

Spa pools have become increasingly popular as people have come to recognize and enjoy the relaxing and healthy benefits accorded by a good invigorating soak in a spa pool or tub. Most conventional spa pools are provided in the form of a spa tub in a bathroom or a health club, or in the form of an outdoor spa. Each of these spa pools has a jet nozzle system having a plurality of nozzles that must be powered by a pump and its associated plumbing (e.g., tubing that connects the nozzles). Some spa pools are also provided with a heater that works in conjunction with the pump to heat the water that is re-circulated in the spa pool.

Unfortunately, in order to move a conventional spa pool to a different location, the entire spa pool and its accompanying jet nozzle system, pump, plumbing and heater must be completely dis-assembled and moved. Such dis-assembly can be quite complex, and often requires the expertise of a plumber. Even if a normal user is able to accomplish the dis-assembly on his or her own, such dis-assembly is very time-consuming and difficult, and any subsequent re-assembly will be equally time-consuming and challenging. In other words, conventional spa pools tend to stay fixed in their original locations, and are unlikely to be moved to a different location.

Such lack of portability is a significant drawback, since nowadays people are more mobile and often enjoy travelling and moving about. It would be desirable if they could also enjoy the luxury and benefit of the spa pool at different locales while not experiencing the inconveniences and difficulties associated with having to assemble and dis-assemble a conventional spa pool. This would encourage and promote increased use of spa pools.

To meet this demand, attempts have been made to provide portable spa pools that can be easily assembled and disassembled. Unfortunately, the plumbing systems for these portable spa pools can still be rather complex. For example, the nozzles need to be fluidly connected to each other (and to a pump) by tubing so that water can be circulated through these nozzles during use. Unfortunately, connecting a plurality of nozzles together can be a rather complicated task, and if not done correctly, can result in leaks and possible malfunction of the plumbing system.

Thus, there remains a need for a portable spa pool that overcomes the problems associated with the conventional spa pools, which can be installed and dis-assembled for storage in a quick and convenient manner, and which can be packed and moved about conveniently.

SUMMARY OF THE DISCLOSURE

It is an objective of the present invention to provide a portable spa pool which can be installed and dis-assembled for storage in a quick and convenient manner, and which can be packed and moved about conveniently.

It is another objective of the present invention to provide a portable spa pool that has a simple construction that minimizes potential leakage.

It is yet another objective of the present invention to provide a portable spa pool having separate modular jet nozzle assemblies, with each jet nozzle capable of being controlled separately from the others.

It is a further objective of the present invention to provide a portable spa pool having the capability of delivering multiple types of bubbles.

It is yet a further objective of the present invention to provide a portable spa pool that prevents back flow of water from the spa pool into the pump.

The objectives of the present invention are accomplished by providing, in one embodiment, a spa pool assembly having a pool having an enclosing wall and a base that together defines an interior. The base has a plurality of inflatable sections that are divided by a plurality of air passages that includes a first air passage that has a plurality of small bubble openings, and a second air passage that has a plurality of large bubble openings. The small bubble openings eject bubbles that are smaller in size than the bubbles ejected from the large bubble openings. The spa pool assembly can also include a bubble controller that controls the ejection of bubbles and fluid from the small bubble openings and the large bubble openings.

DETAILED DESCRIPTION OF THE PREFERRED EMBODIMENTS

Figure 1:
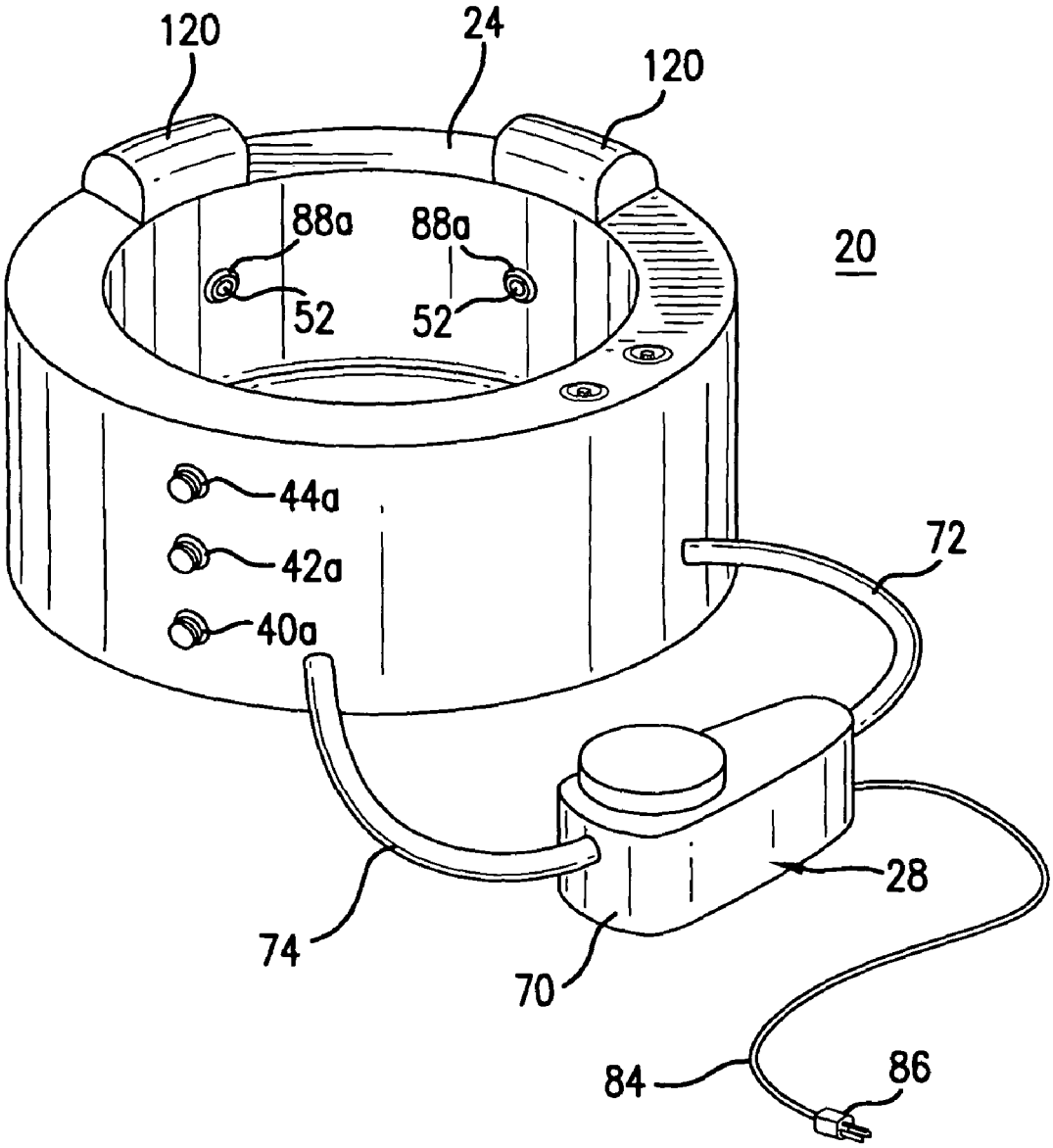
FIG. 1 is a perspective view of a portable spa pool assembly according to one embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides a spa pool that can be easily and quickly assembled and dis-assembled without the need for any special tools. In one embodiment, the spa pool of the present invention provides separate jet nozzle assemblies so that each jet nozzle assembly can be quickly and easily installed by the user. In addition, providing separate jet nozzle assemblies allows the user to control each of them separately, so that the user can customize and vary the jet sprays emitted from these separate jet nozzles. The spa pool of the present invention also provides a simple water circulation system that is easy to install and which minimizes potential leak points.

In another embodiment, air bubbles can be released through one or more air passages provided in the base of the spa pool.

Other benefits and features will be described in connection with the different embodiments of the spa pool hereinbelow.

Referring to FIGS. 1-5B, the present invention provides a portable spa pool assembly 20 that has a pool 22, a liner 24, a plurality of jet nozzle assemblies 26 and a water circulation control unit 28. The pool 22, the jet nozzle assembly 26 and the control unit 28 are each separate from each other and can be modular units that are replaceable or changeable without the need to replace or change the other units.

The pool 22 has an enclosing side wall 30 that defines the interior 32 of the pool 22. The side wall 30 can be provided in three separate sections, a first or lower surrounding inflatable air chamber 34, a second or intermediate surrounding inflatable air chamber 36, and a third or upper surrounding inflatable air chamber 38. In addition, a bottom wall 46 can be connected to the lower air chamber 34. The air chambers 34, 36 and 38 are inflatable to define the shape of the pool 22 when fully inflated, and can be made from a material that is water-impervious and which is capable of tolerating heat and cold. Non-limiting examples of the material can include PVC, rubber, nylon, PU lamination, and polyethylene. The material also acts as a water-containing layer of material that protects against water leakage, and to protect the pool 22 itself from puncture or other damage. In one embodiment of the present invention, the air chambers 34, 36 and 38 are made of a heat and chlorine resistant polyvinylchloride (PVC) material. In one embodiment, the pool 22 can be manufactured by heat sealing the three chambers 34, 36, 38 and the bottom wall 46. The air chambers 34, 36, 38 have valves 40, 42, 44, respectively, through which air can be introduced to inflate the chambers 34, 36, 38. The bottom wall 46 can be inflatable and made from the same material as the chambers 34, 36, 38, or can be merely a sheet of material that is water-impervious and which is capable of tolerating heat and cold.

Alternatively, the pool 22 need not be inflatable. For example, it is also possible to provide the pool 22, its side wall 30 and its bottom wall 46 in a solid piece of foam or other solid material that is molded to the configuration shown in FIGS. 1-2.

Each jet nozzle assembly 26 has a housing 50 that contains the plumbing system (e.g., a motor and a pump), and which is a separate housing that can be removably coupled to the side wall 30 of the pool 22. A jet nozzle 52 is provided on the housing 50, with a tubing 54 connecting the nozzle 52 to a bubble control device 56. Each jet nozzle 52 can be any conventional jet nozzle that is currently available and used for conventional spa pools. For example, two types of jet nozzles 52 can be used include a water flow adjustable nozzle and a non-adjustable nozzle. The jet nozzles 52 can also be one-directional, or multi-directional that are adjustable by the user to massage different areas of the user's back. An electrical wiring 58 extends from the housing 50 to an electrical power plug 60, so that power can be delivered from an external power source (e.g., a power socket in the wall) via the plug 60 and the wiring 58 to power a motor (not shown) inside the housing 50. A water inlet 62 is provided in the housing 50 to allow water from the interior of the pool 22 to be delivered into the housing 50 by a pump (not shown) housed in the housing 50, which subsequently delivers the water to the nozzle 52 to be ejected by the nozzle 52. Even though the motor and the pump of the jet nozzle assembly 26 are not shown, they can be constructed according to motors and pumps that are well-known in the spa art for pumping water to be ejected through a nozzle.

The water circulation control unit 28 can include a filter pump (not shown) and a heater (not shown) that are housed inside a housing 70. The filter pump and heater are all well-known in the art, and the assembly of a filter pump and a heater together into a modular component has already been done for conventional spa systems, and one non-limiting example is the PS-1 System marketed by Spa Builders System Group. The heater can be automatically activated by a water pressure sensor (built into the heater) which turns on the heater when water begins to travel through it. The heater can also be provided with an automatic maximum temperature cut-off if the water reaches a pre-selected maximum temperature (e.g., 104 degrees Fahrenheit). The heater is optional and can be omitted.

Figure 2:
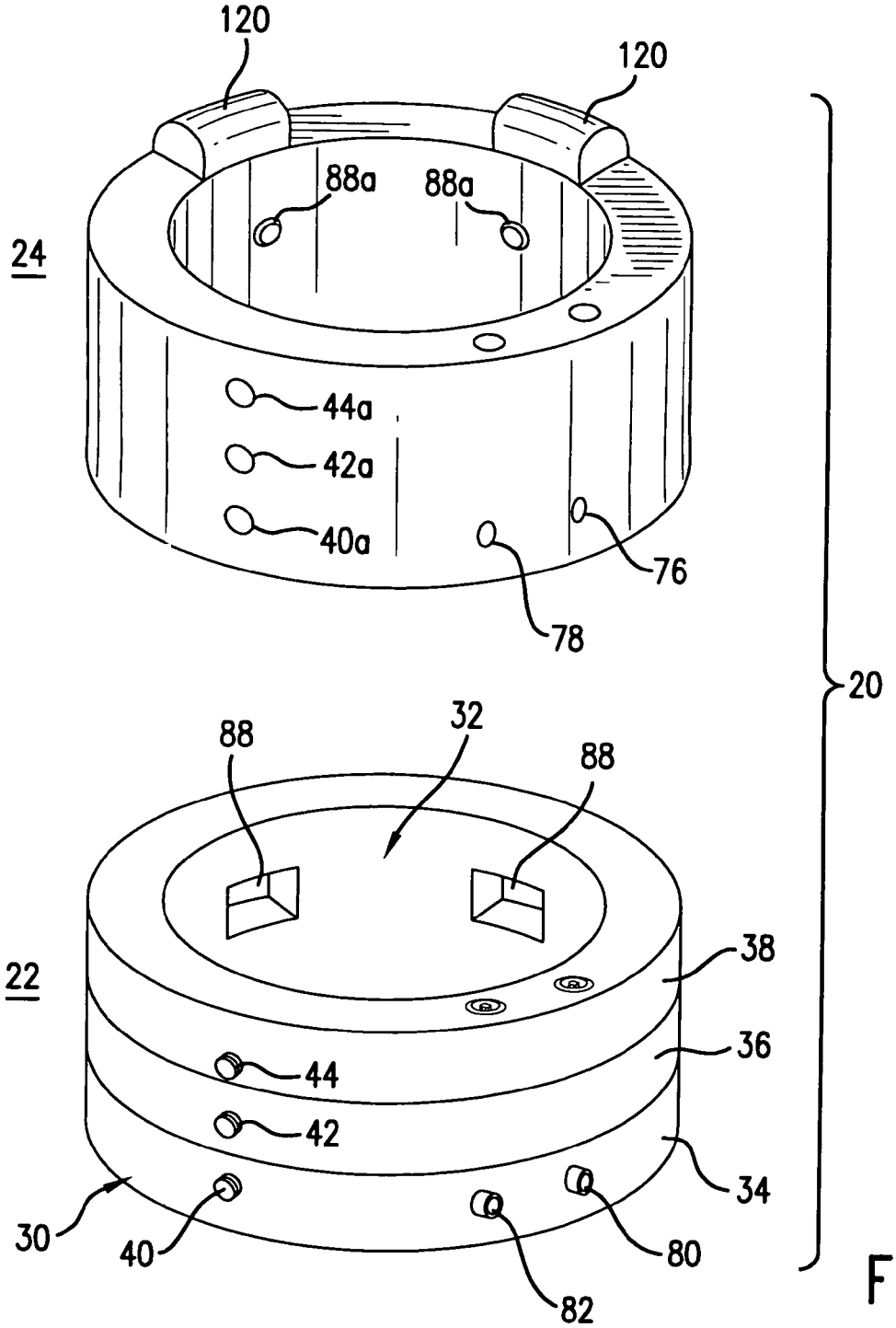
FIG. 2 is an exploded perspective view of the spa pool assembly of FIG. 1.
Figure 3:
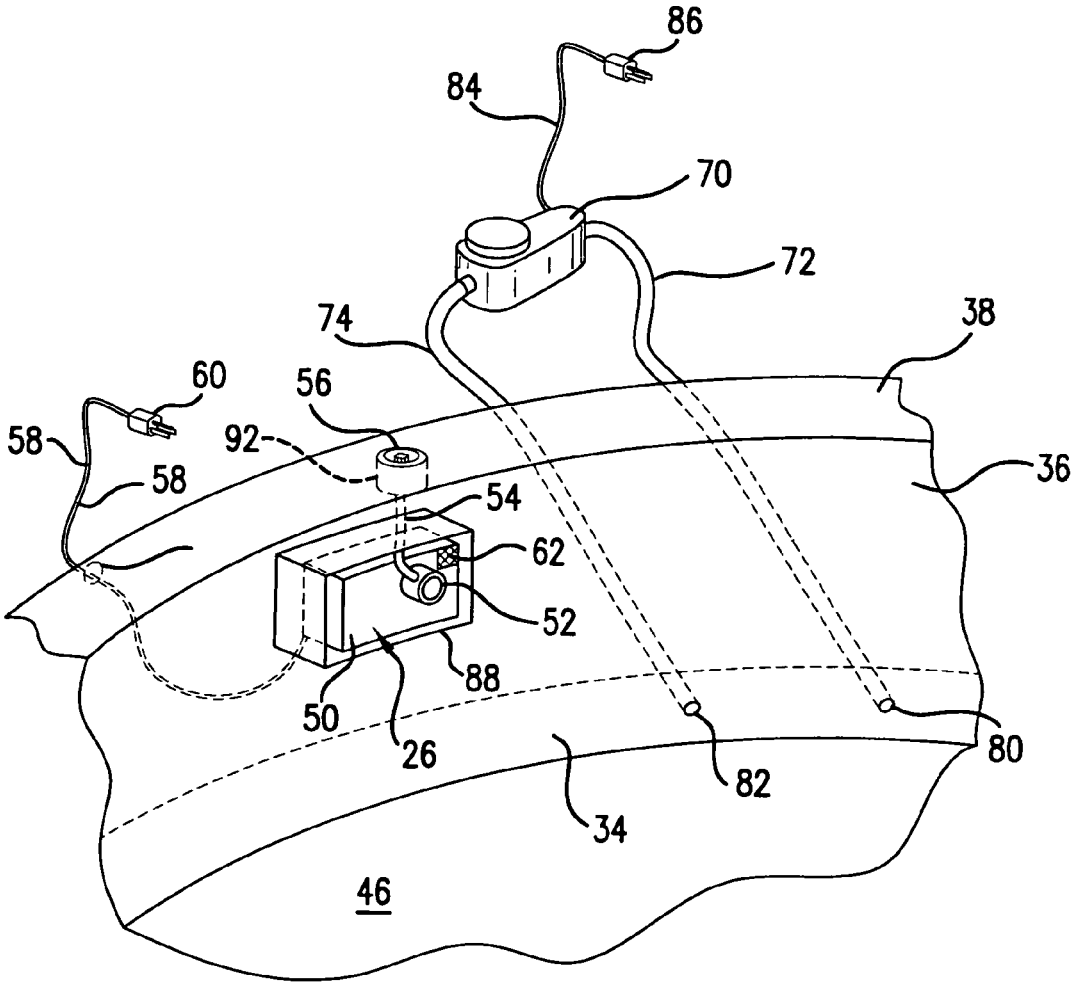
FIG. 3 is an enlarged sectional view of a portion of the spa pool of FIG. 1.

A water intake tubing 72 extends from the housing 70 and is adapted to deliver water from the interior of the pool 22 to the control unit 28. A water outlet tubing 74 extends from the housing 70 and is adapted to deliver water from the control unit 28 back to the interior of the pool 22. As best shown in FIGS. 2 and 3, the tubings 72 and 74 extend through openings 76 and 78 respectively, in the liner 24, and through ports 80 and 82, respectively, in the side wall 30 (e.g., in the air chamber 34). An electrical wiring 84 extends from the housing 70 to an electrical plug 86, so that power can be delivered from an external power source (e.g., a power socket in the wall) via the plug 86 and the wiring 84 to power a motor (not shown) inside the housing 70.

The control unit 28 functions to draw water (using the filter pump) via the intake tubing 72 into the housing 70 where the water is filtered by the filter pump and heated by the heater. The processed water is then returned to the interior of the pool 22 via the outlet tubing 74. Thus, the water inside the pool 22 can be constantly recirculated and processed to keep it clean and heated to the desired temperature.

Each tubing 54, 72, 74 can be made from the same material, such as PVC, and can have weaved nylon reinforcements laminated into the hose itself. The tubings 54, 72, 74 should preferably be able to withstand high water pressure and heat.

Figure 4:
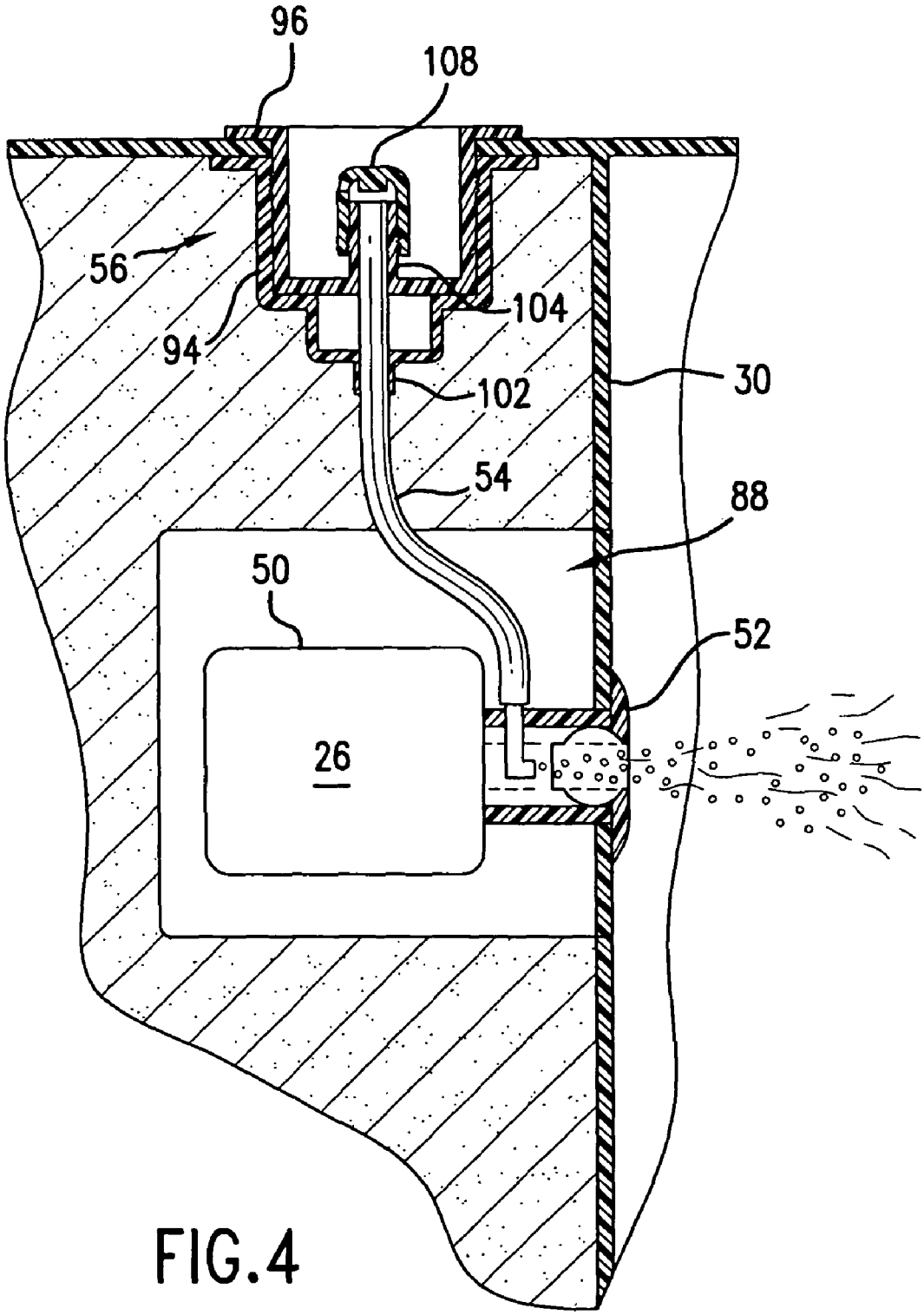
FIG. 4 is a cross-sectional side plan view of the bubble control device that is used for the spa pool of FIG. 1.
Figure 5:
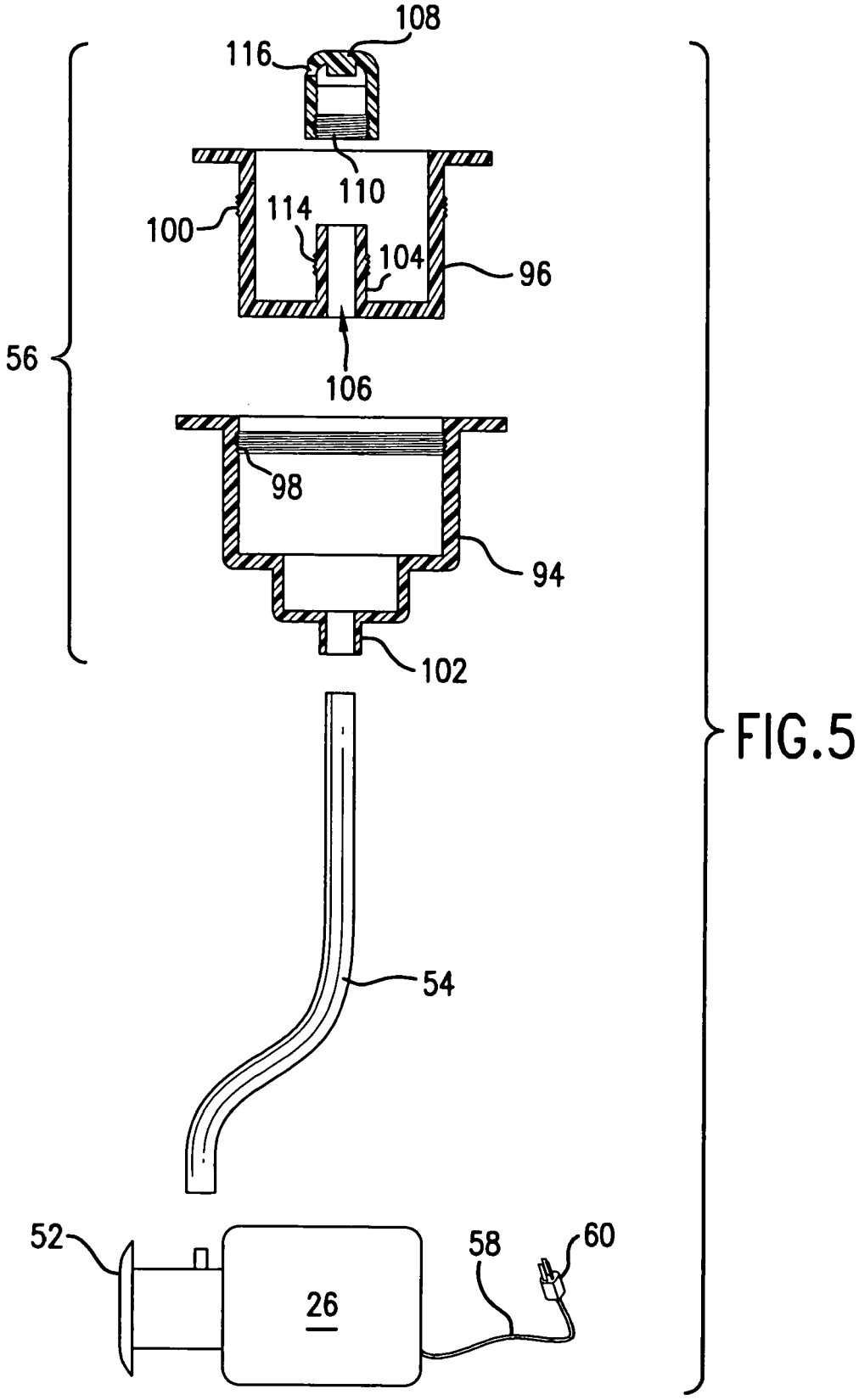
FIG. 5 is an exploded cross-sectional view of the bubble control device that is used for the spa pool of FIG. 1.

The bubble control device 56 is illustrated in greater detail in FIGS. 4 and 5. The bubble control device 56 includes a rounded container 94 and a generally U-shaped cover 96 that is adapted to be fitted inside the container 94. A plurality of internal threads 98 are provided on the inner wall of the container 94, and are adapted to threadably engage a plurality of external threads 100 that are provided on the outer wall of the cover 96. The tubing 54 is connected to an opening 102 provided at the center of the bottom of the container 94. A central tube 104 extends upwardly into the interior of the cover 96 from the center of the bottom of the cover 96, and has a bore 106 that communicates the interior of the cover 96 with the interior of the container 94. In addition, the bore 106 is aligned with the opening 102. A cap 108 is adjustably coupled to the tube 104 to control the amount of air that is allowed to flow from the environment to the nozzle 52. Specifically, the cap 108 has internal threads 110 that are adapted to threadably engage external threads 114 provided on the tube 104. In addition, one or more air openings 116 are provided in the wall of the cap 108, so that air from the environment can flow through the openings 116 into the bore 106, and then through the opening 102 and the tubing 54 to the nozzle 52. Thus, turning the cap 108 with respect to the tube 104 will cause the cap 108 to travel along the threads 110, 114 to go up or down along the tube 104. Depending on the extent to which the cap 108 is turned, some of the openings 116 will be opened or closed, thereby varying the amount of air that can flow from the environment to the nozzle 52.

To assemble the spa pool assembly 20, the pool 22 is inflated by partially inflating the air chambers 34, 36, 38. Each jet nozzle assembly 26 is then installed in the following manner. The housing 50 for each jet nozzle assembly 26 is inserted into a cavity 88 that is provided in the side wall 30 (e.g., the air chamber 36), and which opens into the interior of the pool 22. The wiring 58 for each jet nozzle assembly 26 is extended through an opening 90 in the side wall 30 to the exterior of the pool 22, and the plug 60 is plugged into a power socket. In addition, the tubing 54 of the bubble control device 56 is extended through the interior of the side wall 30 to an opening 92 provided in the top of the side wall 30 (e.g., at the top of the air chamber 38). The container 94 is then positioned in the opening 92, and the tubing 54 is coupled to the opening 102. The cover 96 and its cap 108 are then secured over the container 94. The jet nozzle assemblies 26 are now ready for use. The cap 108 for each bubble control device 56 can be adjusted to adjust the jet spray for each corresponding nozzle 52.

Next, the user completes the inflation of the air chambers 34, 36, 38, and then uses the liner 24 to completely cover the pool 22. The liner 24 can completely cover all the surfaces of the pool 22, including the interior and the exterior surfaces of the pool 22. The liner 24 can be provided with a zipper, buttons, or other similar mechanism (not shown) to zip up the liner 24 when the liner 24 has completely surrounded the pool 22. The liner 24 can be provided with openings 88*a*, 40*a*, 42*a*, 44*a* that are aligned with (and correspond with) the cavities 88 and the valves 40, 42, 44, respectively, in the pool 22.

The user then installs the control unit 28 by extending the tubings 72 and 74 through the openings 76 and 78 respectively, in the liner 24, and through the ports 80 and 82, respectively. The tubings 72 and 74 are then connected to the housing 70, and the plug 86 is plugged into a power socket. The control unit 28 is now ready for use.

Optionally, pillow bladders (not shown) can be inflated and inserted into pillow chambers 120 provided at the top of the liner 24. These pillow bladders 120 function as head pillows for the occupants of the spa pool assembly 20.

Water can be filled into the interior of the pool 22 to the required water level (preferably above the level of the nozzles 52), and the pumps in the jet nozzle assemblies 26 and the control unit 28 primed by drawing water from the pool 22 into the respective pumps. Once the pumps have been primed, the pump is ready to begin recirculating water. The spa pool assembly 20 is now ready for use.

Thus, as described above, the spa pool assembly 20 can be assembled very quickly and conveniently. No tubing is needed to connect the nozzles 52, since each jet nozzle assembly 26 operates as a stand-alone unit that is separate from the other jet nozzle units 26. As a result, the construction and assembly of the spa pool assembly 20 is greatly simplified.

During use, the user can adjust each jet nozzle 52 separately by controlling the bubble control device 56. In particular, the user can adjust the cap 108 on the cover 96 in the manner described above to control the amount of bubbles being ejected by the corresponding nozzle 52. Since the cap 108 essentially controls the amount of air present inside the container 94, adjusting the cap 108 to decrease the space inside the container 94 will result in a weaker jet of bubbles being ejected by the corresponding nozzle 52 (because there is less air), and adjusting the cap 108 to increase the space inside the container 94 will result in a stronger jet of bubbles being ejected by the corresponding nozzle 52 (because there is more air). Thus, the user can vary the strength of each different nozzle 52 by adjusting each separate bubble control device 56.

In addition, the use of a single water intake tubing 72 and a single water outlet tubing 74 minimizes the number of openings in the pool 22, thereby reducing the likelihood of leakage and other defects.

To dis-assemble the spa pool assembly 20, the user turns off the respective motors, and disconnects all the components by reversing the steps described above. The jet nozzle assemblies 26 are then separately removed from the pool 22. The air chambers 34, 36, 38 are then deflated and all the components can be packed for storage or transportation. A carrying case (not shown) can be provided for storing the different components: the jet nozzle assemblies 26, the control unit 28, the tubings 72, 74, the bubble control devices 56, the pool 22, and the liner 24.

The modularity of the different units 22, 24, 26, 28, 56, 72, 74 also provides several important benefits. First, the modularity allows for convenient replacement of defective units without the need to replace non-defective units. Second, the modularity increases the convenience of assembly, dis-assembly, servicing and maintenance of the spa pool assembly 20. Third, the assembly and disassembly of the spa pool assembly 20 does not require the use of special tools, thereby allowing the spa pool assembly 20 to be conveniently moved about for use in many different locations.

Figure 6:
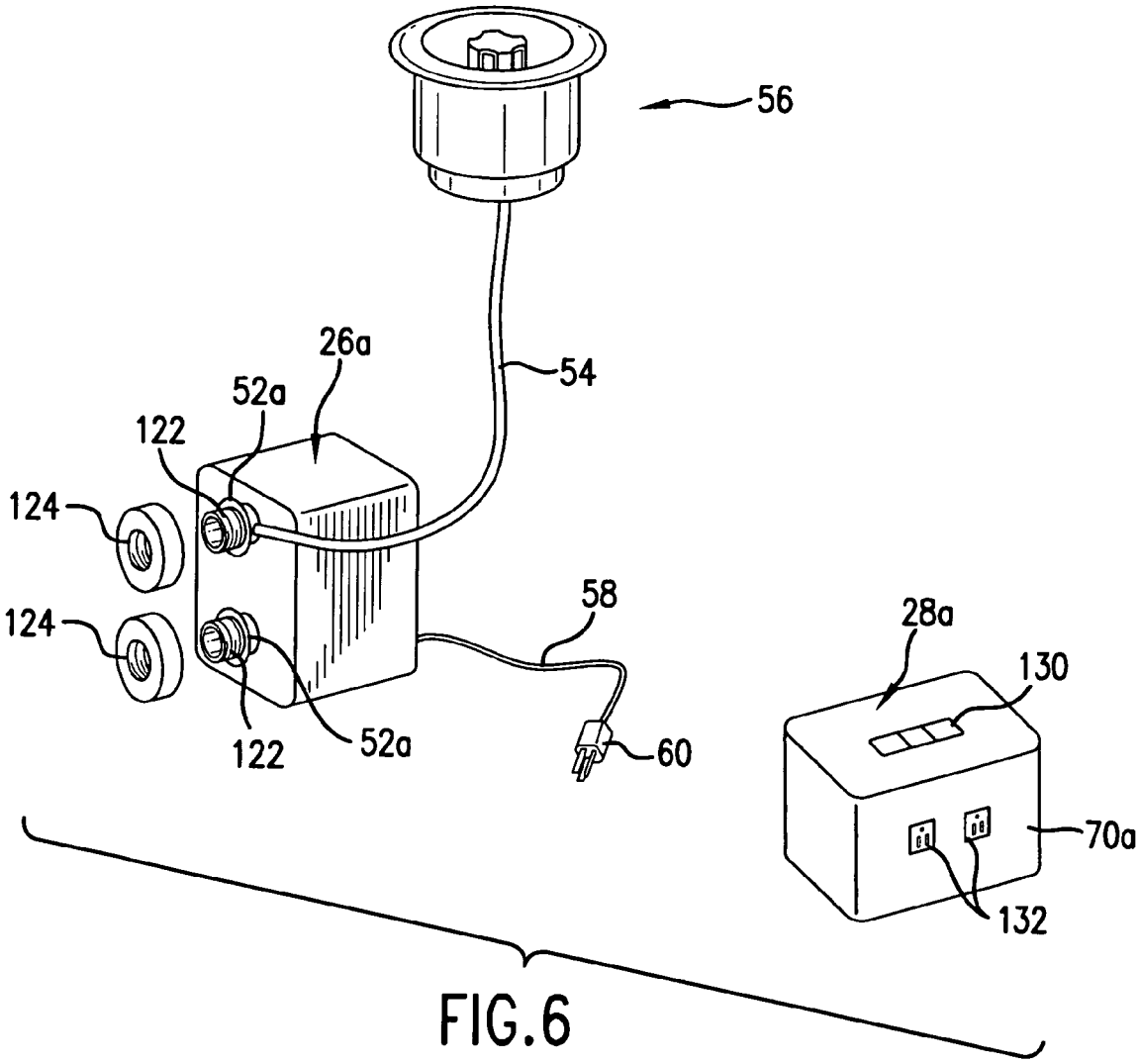
FIG. 6 is an exploded view illustrating a jet nozzle assembly and control unit according to another embodiment of the present invention.
Figure 7:
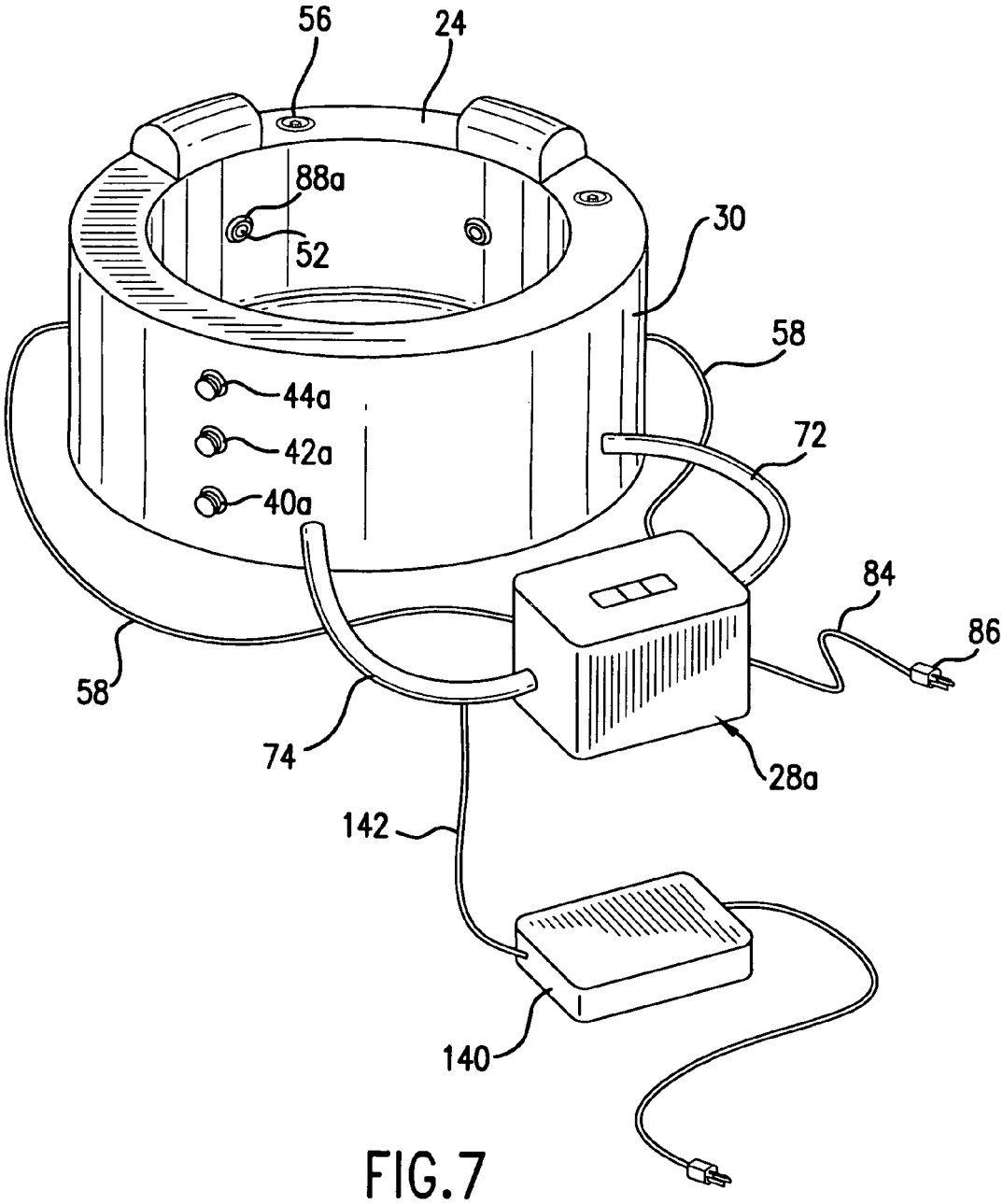
FIG. 7 illustrates the spa pool of FIG. 1 shown in use with the jet nozzle assembly and control unit of FIG. 6.
Figure 8:
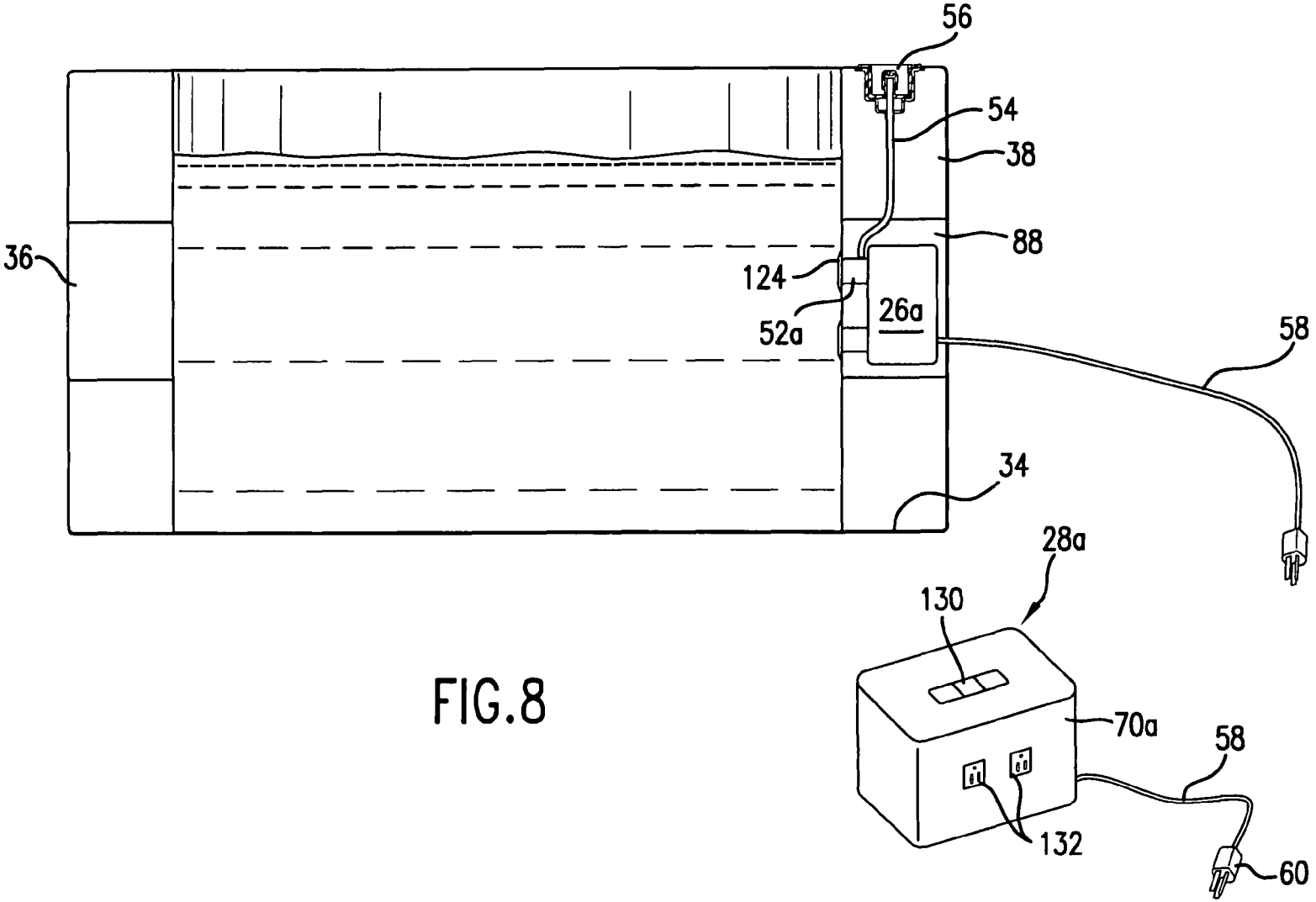
FIG. 8 is a cross-sectional view illustrating the spa pool of FIG. 1 shown in use with the jet nozzle assembly and control unit of FIG. 6.
Figure 9:
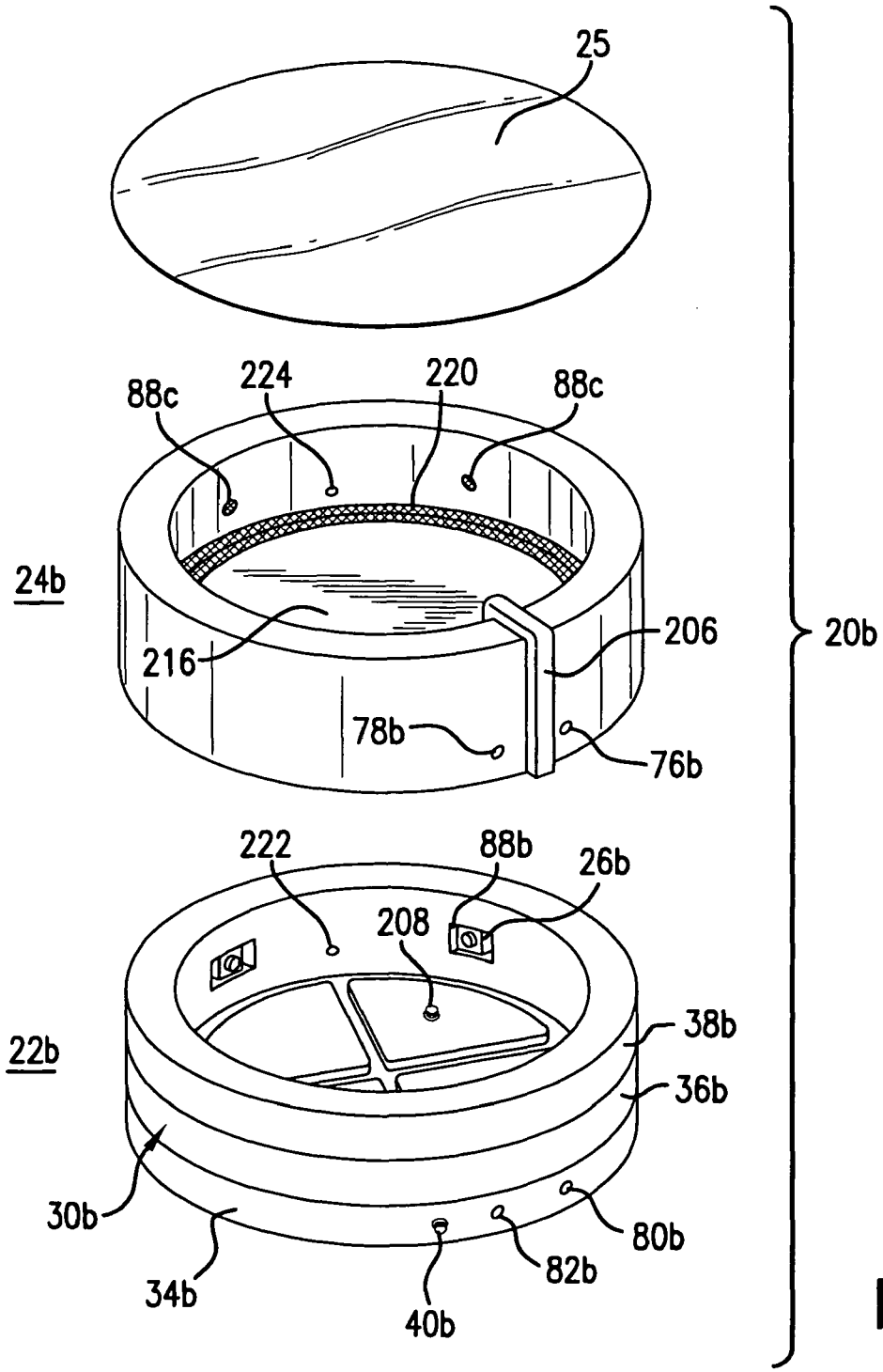
FIG. 9 is an exploded perspective view of a portable spa pool assembly according to another embodiment of the present invention.
Figure 10:
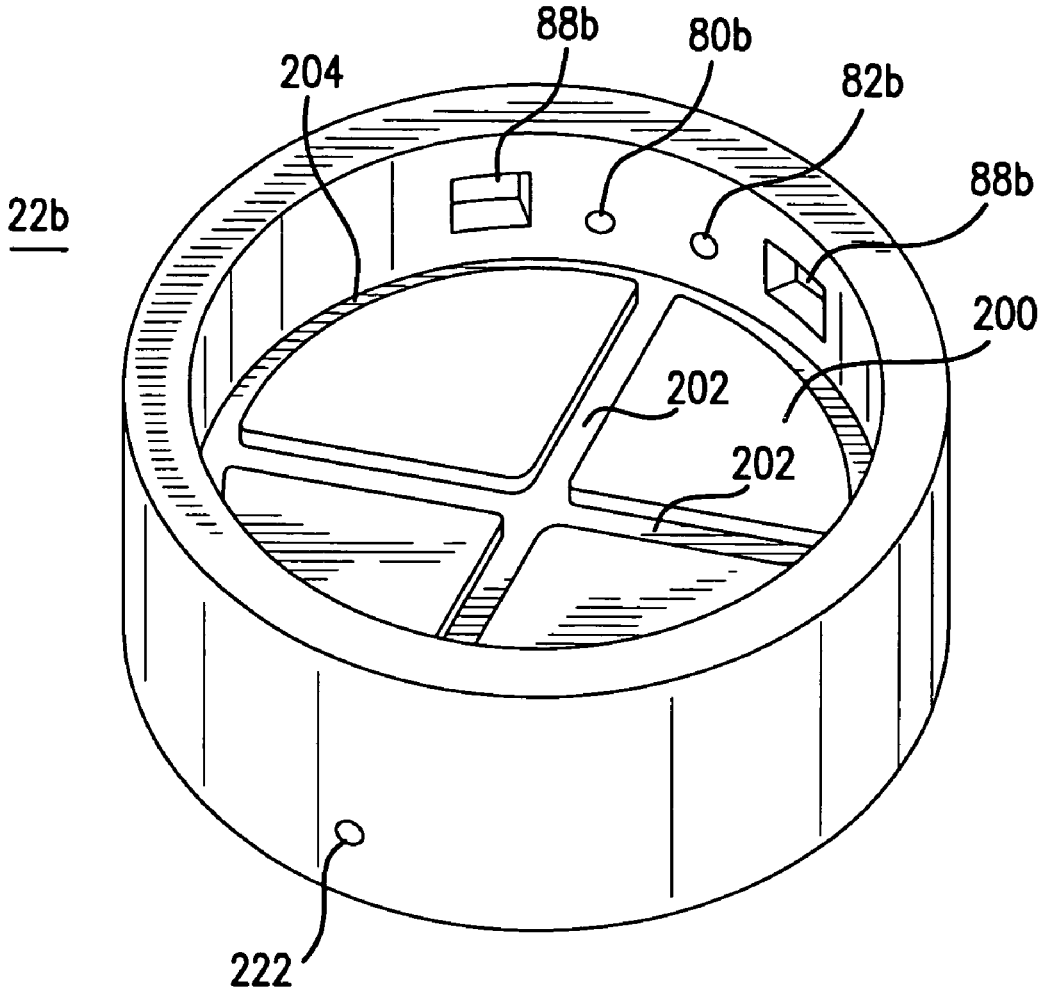
FIG. 10 is a perspective view of a modified pool of the portable spa pool assembly of FIG. 9.

FIGS. 6-8 illustrate some modifications that can be made to the jet nozzle assemblies 26 and the control unit 28 described above. First, each jet nozzle assembly 26*a* can be the same as the jet nozzle assembly 26 described above, except that each nozzle 52*a* can be provided in a tubular configuration with external threads 122 that are adapted to receive a threaded nut 124. Thus, each tubular nozzle 52*a* can extend through an opening 88*a* in the liner 24, and the nut 124 can be threadably secured to the nozzle 52*a* from inside the spa pool assembly 20, so as to secure the nozzle 52*a* to the location of the opening 88*a*.

Second, the control unit 28*a* can be the same as the control unit 28 described above, except that individual control switches 130 can also be provided to allow the user to separately control the individual jet nozzle assemblies 26*a*. In addition, power receptacles 132 are provided in the housing 70*a*, each adapted to receive a power plug 60 of a separate jet nozzle assembly 26*a*. Thus, by turning on selected switches 130 and turning off selected switches 130, the user can control which jet nozzle assemblies 26*a* are turned on or off, while also being able to adjust the strength of the jet of water at each nozzle 52*a* via the corresponding bubble control device 56.

As a further alternative, as best shown in FIG. 7, an ozonator 140 can be coupled to the tubing 74 via a separate line 142. The ozonator 140 functions to generate ozone to sanitize the spa pool assembly 20.

FIGS. 9-13 illustrate another embodiment of the present invention. The spa pool assembly 20*b* in FIGS. 9-13 can be the same as the spa pool assembly 20 in FIGS. 1-5 except for the differences noted below, so the same numeral designations will be used to designate the same elements in FIGS. 1-5 and FIGS. 9-13, except that a "b" or a "c" is added to the corresponding elements in FIGS. 9-13.

The pool 22*b* is provided with a multi-sectional base or bottom wall 46*b* that has a plurality of different sections 200 that are divided by passages 202. In the embodiment of FIGS. 9-13, there are four sections 200 that are divided by two perpendicular passages 202 that intersect each other. In addition, there is a circumferential passage 204 that extends around the edge of the base 46*b* and separates the sections 202 from the bottom chamber 34*b*. The passages 202 and 204 communicate with each other, and are essentially embodied in the form of grooves that are formed between the chamber 34*b* and the sections 200. Each section 200 can be inflated separately via valves 208, which can be single or multi-valves.

Figure 11:
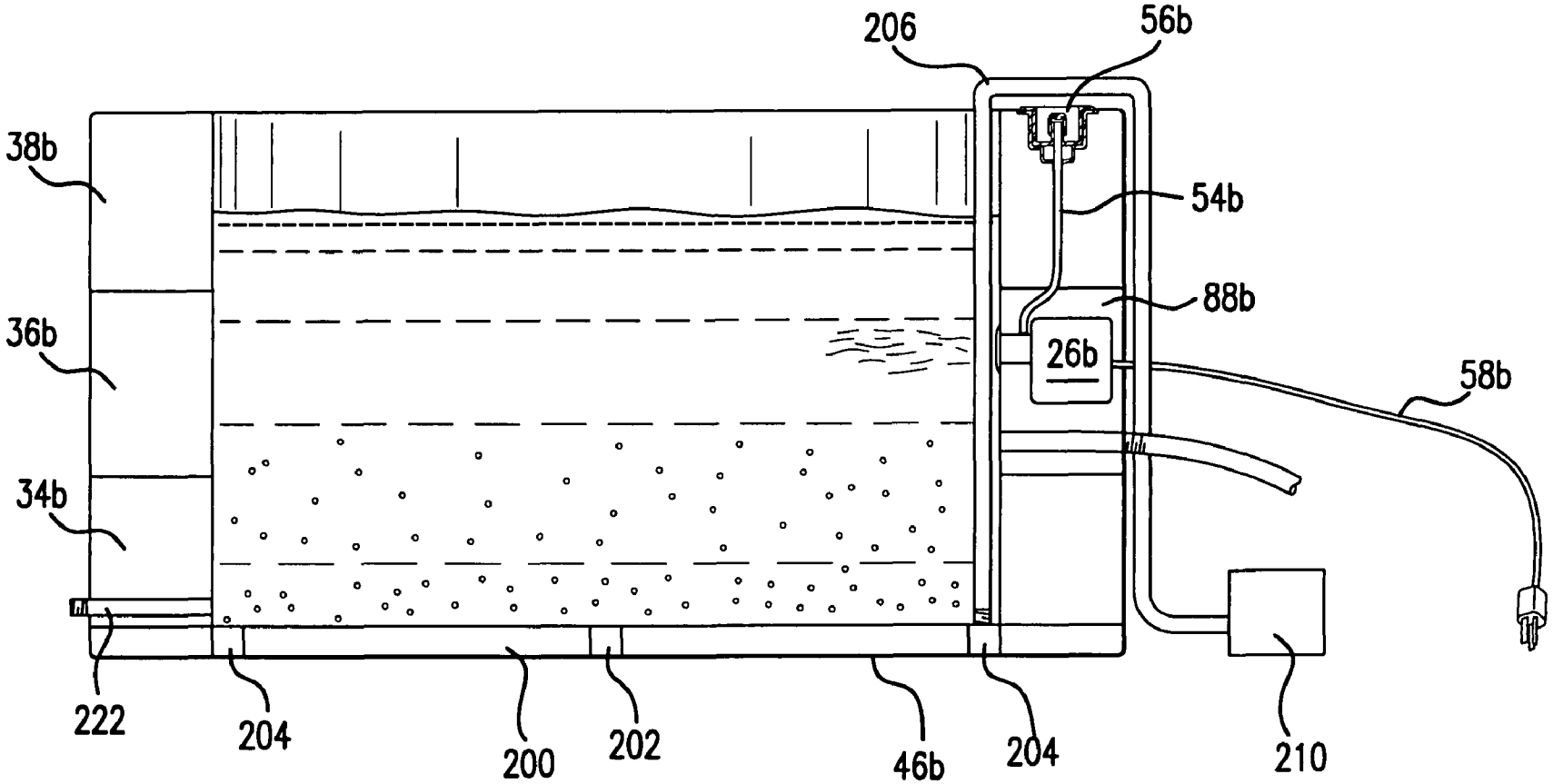
FIG. 11 is a cross-sectional view of the portable spa pool assembly of FIG. 9.
Figure 12:
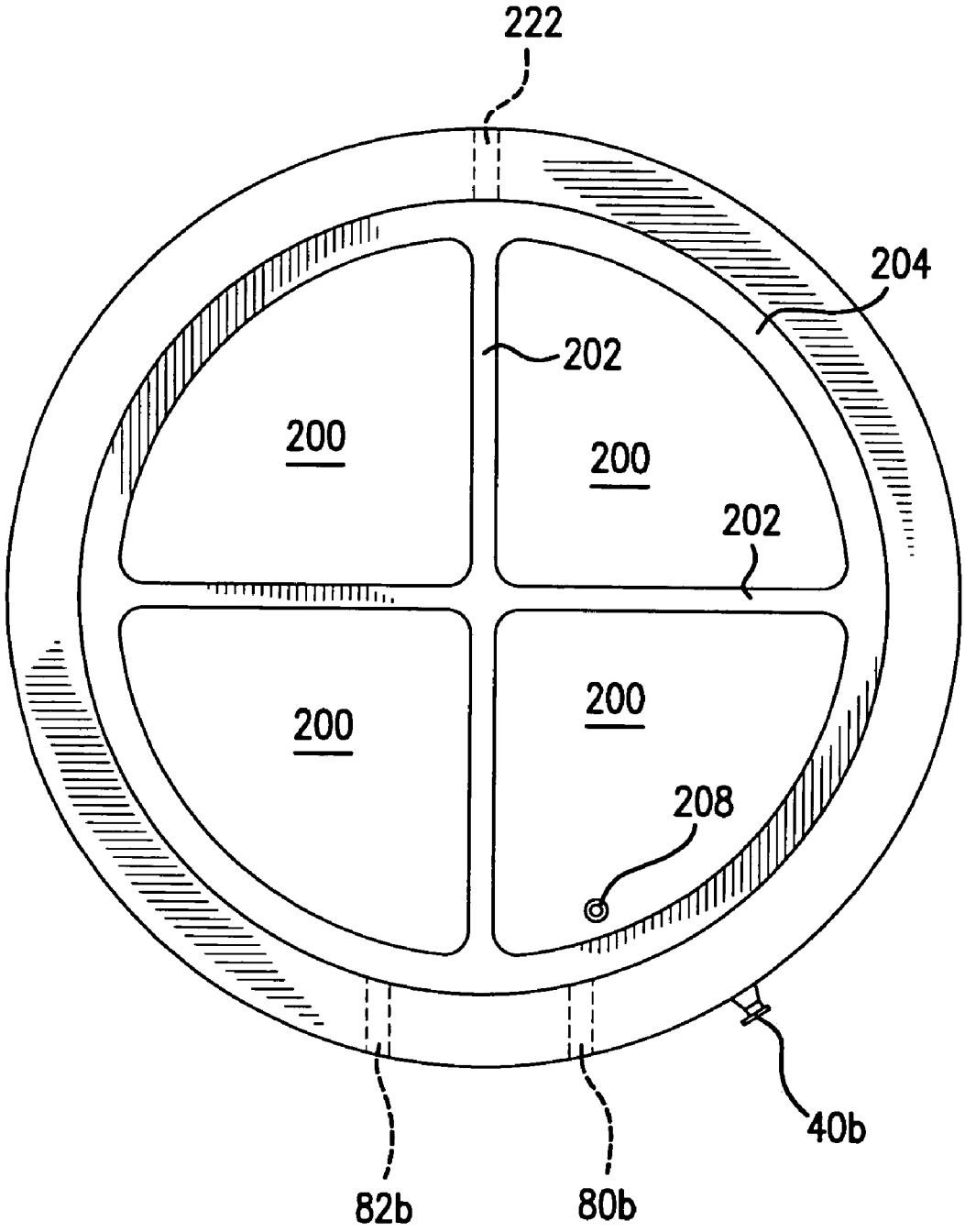
FIG. 12 is a top plan view of the spa pool of FIG. 10.
Figure 13:
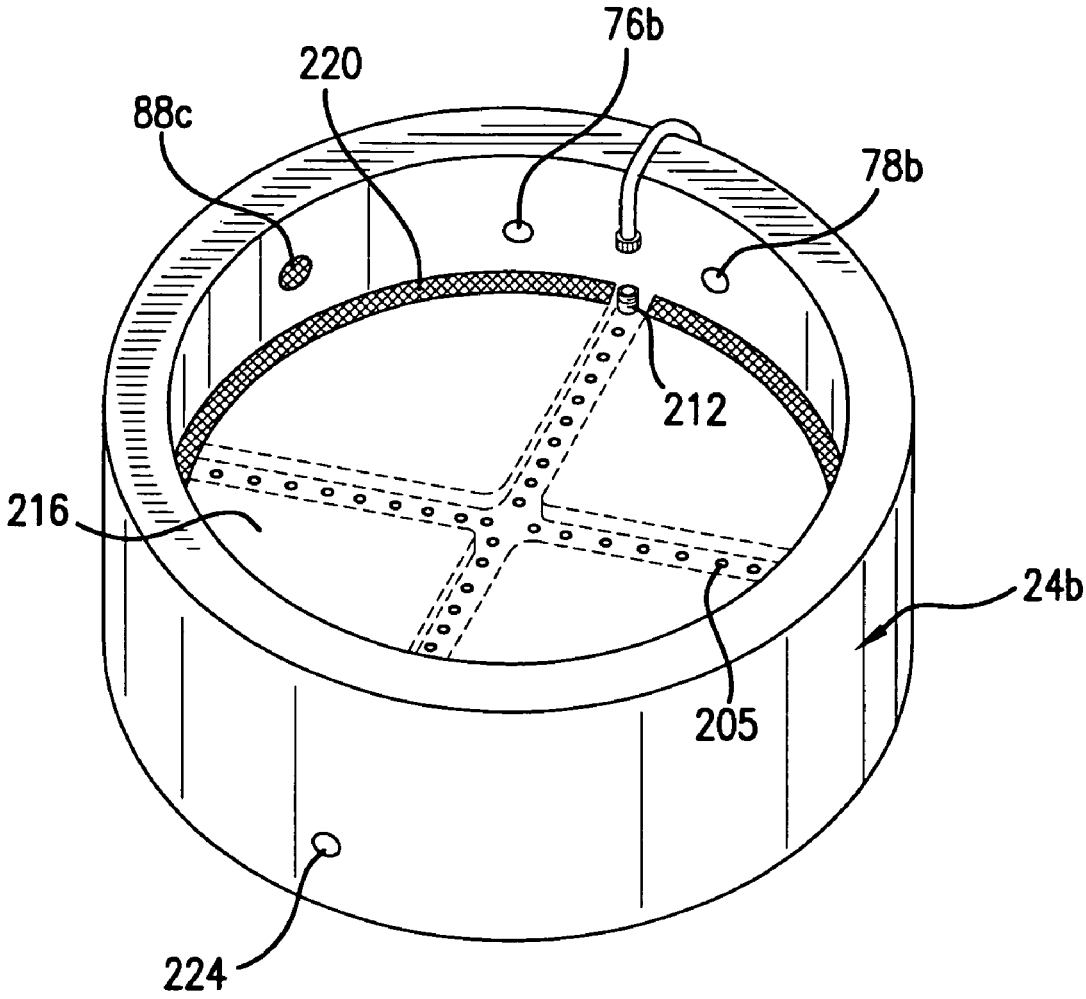
FIG. 13 is a top perspective view of the portable spa pool assembly of FIG. 9.

As shown in FIG. 11, an air hose 206 has a first end that is connected to an air bubble generator 210 at the exterior of the pool 22*b* and extends over the wall 30*b* into the pool 22*b* to a manifold 212 (see FIG. 13) in the liner 24*b* to its second end which fluidly communicates with the passage 204. The liner 24*b* has a meshed material 220 in its base 216 that is aligned with the passage 204, and the liner 24*b* further includes holes 205 that are aligned with the passages 202. Air is introduced via the air hose 206 to the passages 202 and 204, circulates through the passages 202, 204, and then exits through the meshed material 220 and the holes 205 provided on the base 216 to the interior of the pool 22*b*.

The passages 202 and 204 allow for circulated air to be propelled from additional sources towards the people sitting in the pool 22*b*. In particular, the air bubbles from the passages 202, 204 provide a massage function from the bottom.

In addition, the pool 22*b* includes a drain port 222 that is aligned with the drain opening 224 in the liner 24*b*. Water from the interior of the pool 22*b* can be drained via the drain port 222 and the drain opening 224. A cover 25 can be placed over the top of the pool 22*b* and the liner 24*b*.

Figure 14:
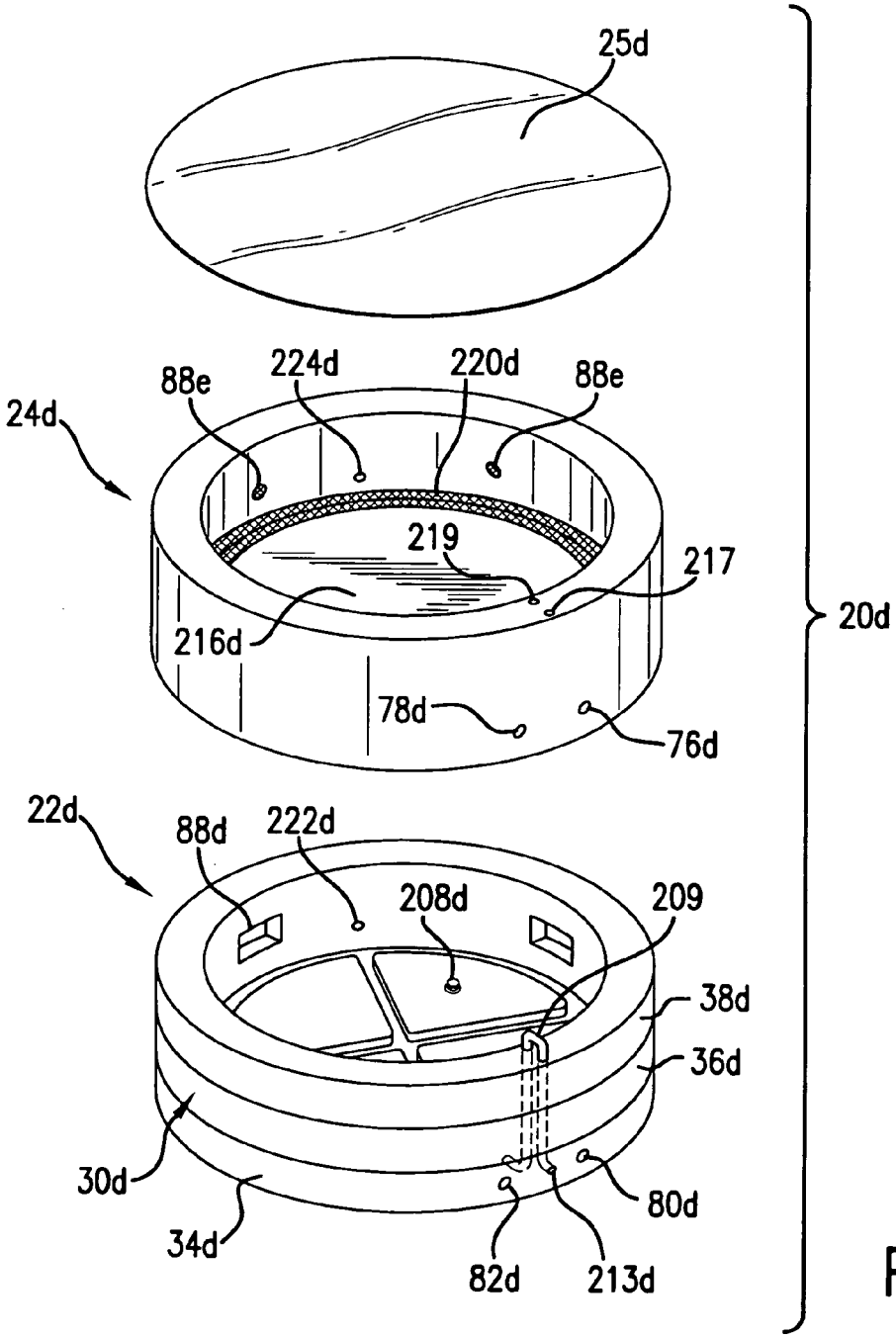
FIG. 14 is an exploded perspective view of a portable spa pool assembly according to yet another embodiment of the present invention.
Figure 15:
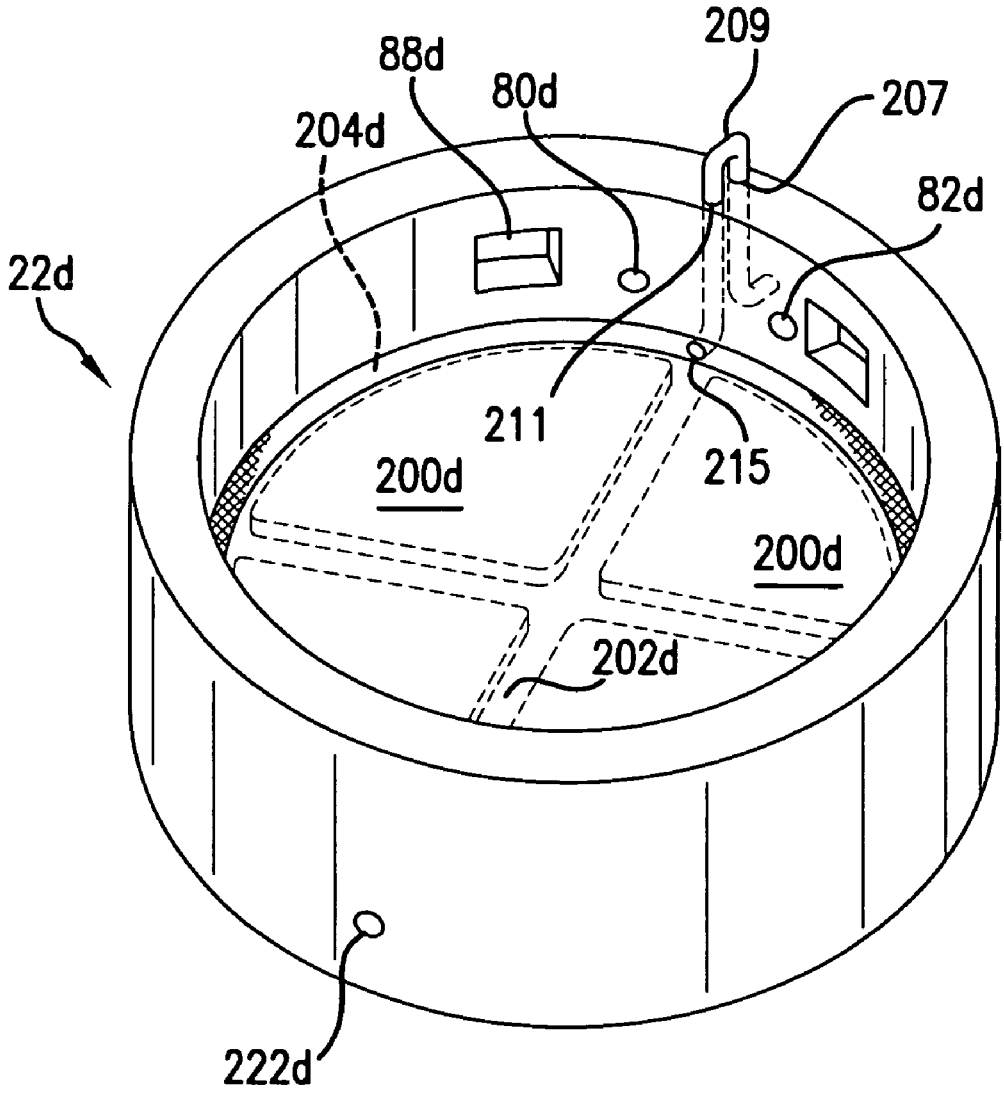
FIG. 15 is a perspective view of a modified pool of the portable spa pool assembly of FIG. 14.
Figure 16:
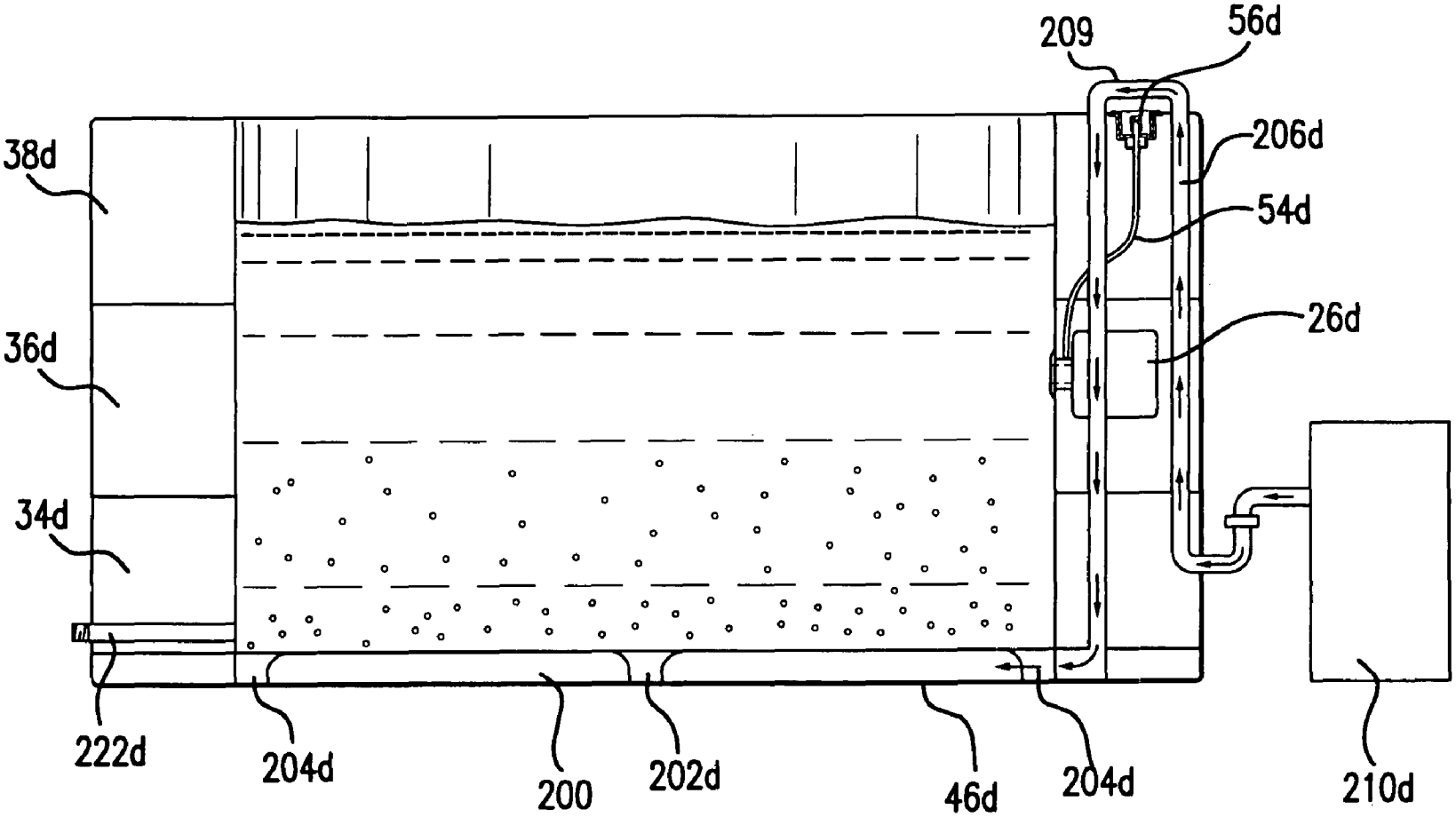
FIG. 16 is a cross-sectional view of the portable spa pool assembly of FIG. 14.

FIGS. 14-16 illustrate yet another embodiment of the present invention. The spa pool assembly 20*d* in FIGS. 14-16 can be the same as the spa pool assembly 20*b* in FIGS. 9-13 except for the differences noted below, so the same numeral designations will be used to designate the same elements in FIGS. 9-13 and FIGS. 14-16, except that a "d" or an "e" is added to the corresponding elements in FIGS. 14-16.

The spa pool 22*d* is essentially the same as the spa pool 22*b*, except that the air hose 206*d* now extends through the wall 30*d*. Specifically, the air hose 206*d* has a first end that is connected to an air bubble generator 210*d* at the exterior of the pool 22*d* and extends via an opening 213*d* in the wall 30*d* to the interior of the chambers 34*d*, 36*d*, 38*d*. The air hose 206*d* extends upwardly in the wall 30*d* and exits the top of the chamber 38*d* via an opening 207 to a U-shaped curve 209, which then extends back into the chamber 38*d* via another opening 211. The air hose 206*d* then extends downwardly in the wall 30*d* until it reaches the bottom of the wall 30*d* where it exits through an opening 215 in the chamber 34*d*. The opening 215 communicates with the passages 202*d* and 204*d*. The liner 24*d* has a meshed material 220*d* in its base 216*d* that is aligned with the passage 204*d*. Air is introduced via the air hose 206*d* to the passages 202*d* and 204*d*, circulates through the passages 202*d*, 204*d*, and then exits through the meshed material 220*d* and the holes (not shown in FIGS. 14-16, but same as 205) provided on the base 216*d* to the interior of the pool 22*d*.

Openings 217 and 219 can be provided in the liner 24*d* and adapted to be aligned with the openings 207 and 211 in the spa pool 22*d* so that the air hose 206*d* can extend through these openings 207, 211, 217 and 219.

The U-shaped air passage defined by the air hose 206*d* provides a safety feature over the air hose 206 shown in FIGS. 9-13 in that it can minimize the back flow of water to the air bubble generator 210*d* when the power is turned off. By providing the U-shaped curve 209 at a vertical level that is higher than the water level in the spa pool 22*d*, any siphoning effect can be avoided when the power is turned off.

Figure 17:
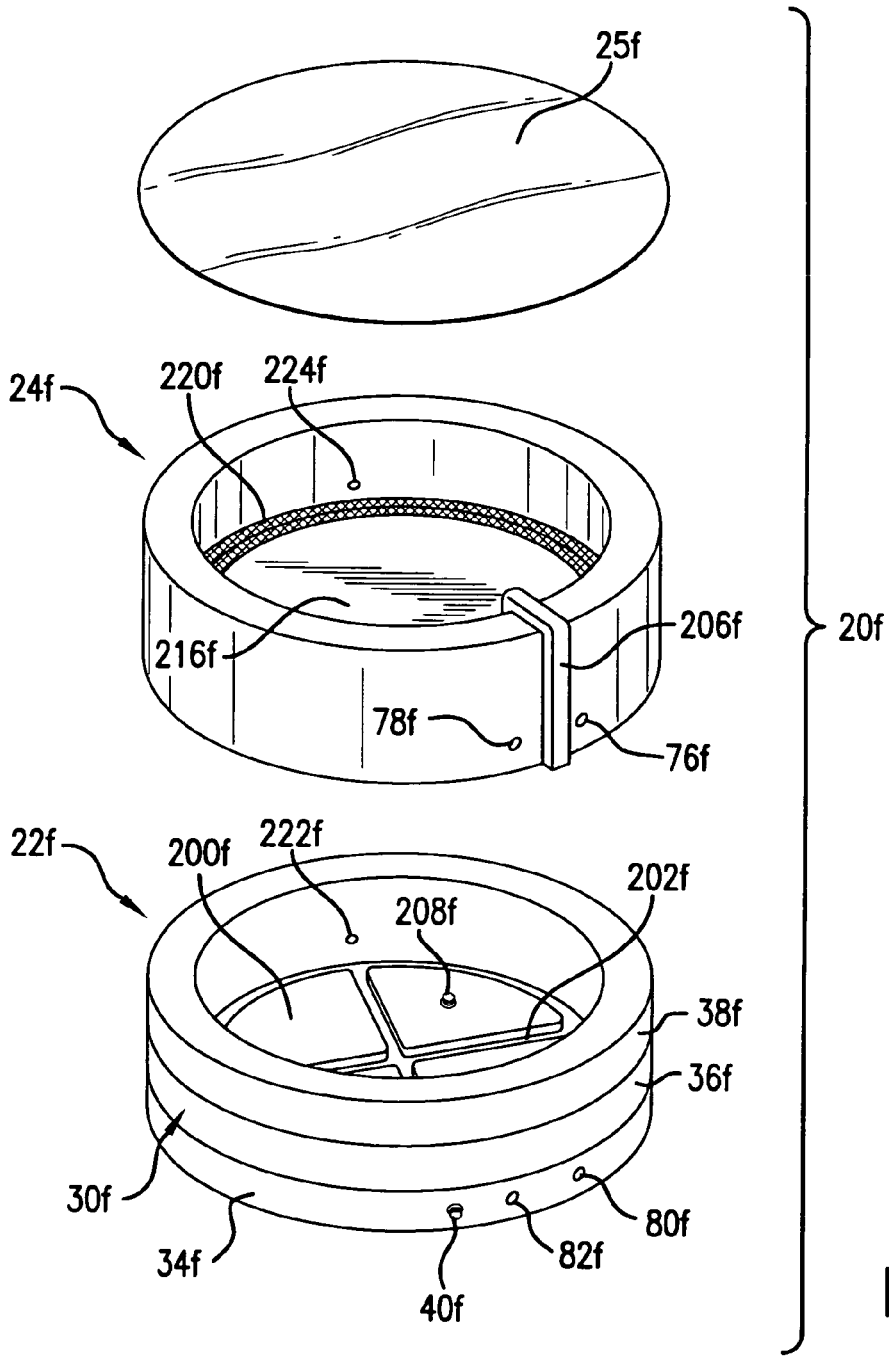
FIG. 17 is an exploded perspective view illustrating a modification made to the portable spa pool assembly of FIG. 9.
Figure 18:
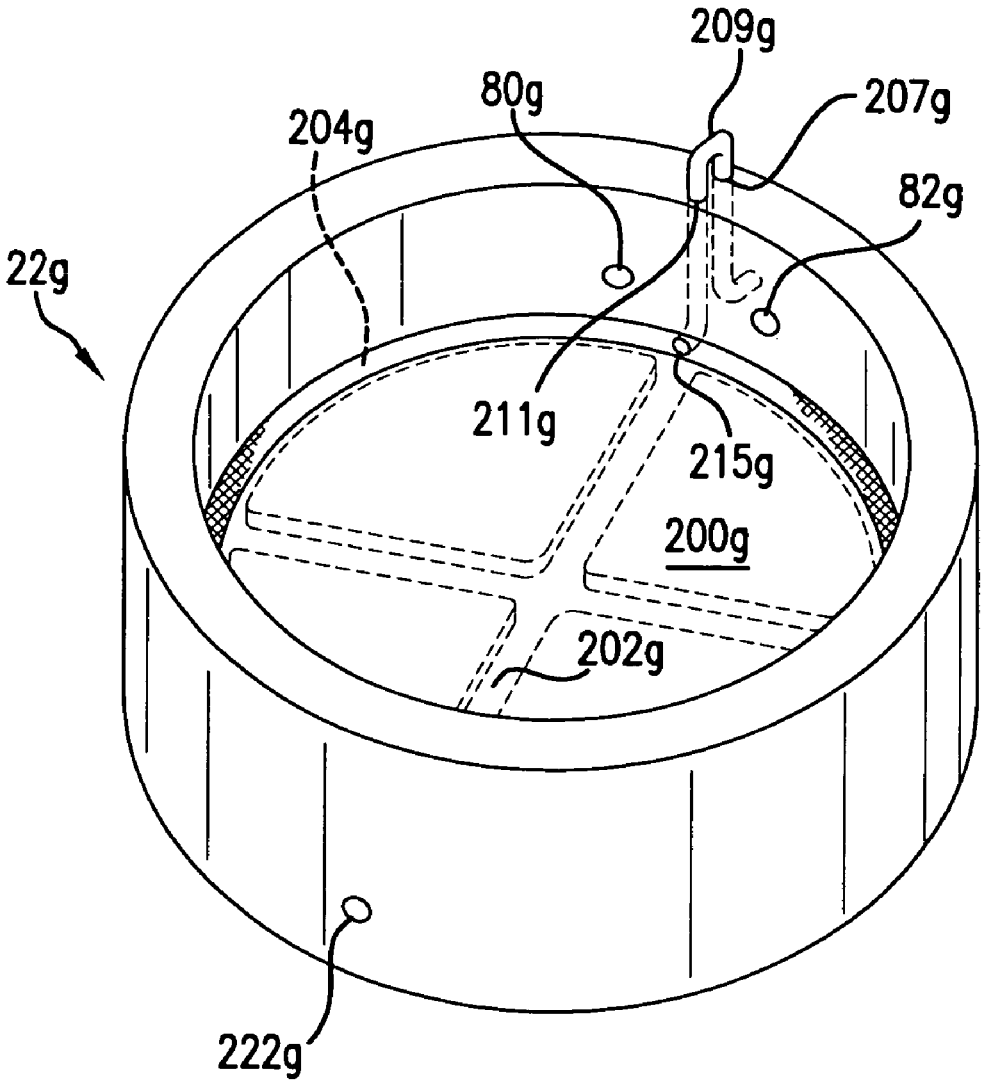
FIG. 18 is a perspective view illustrating a modification made to the portable spa pool of FIG. 10.

FIGS. 9-16 illustrate the provision of air bubbles from the base or bottom wall 46*b*. As a result, it is possible to omit the jet nozzle assemblies 26*b*. FIG. 17 illustrates the spa pool assembly 20*b* with the jet nozzle assemblies 26*b* omitted. The resulting spa pool assembly 20*f* in FIG. 17 is otherwise the same as the spa pool assembly 20*b* in FIGS. 9-13, so the same numeral designations will be used to designate the same elements in FIGS. 9-13 and FIG. 17, except that an "f" is added to the corresponding elements in FIG. 17. Similarly, FIG. 18 illustrates the spa pool 22*d* with the jet nozzle assemblies omitted. The resulting spa pool 22*g* in FIG. 18 is otherwise the same as the spa pool 22*b* in FIGS. 14-16, so the same numeral designations will be used to designate the same elements in FIGS. 14-16 and FIG. 18, except that a "g" is added to the corresponding elements in FIG. 18.

FIGS. 19-22 illustrates modifications that can be made to the spa pool assembly 22*g* in FIG. 18. The spa pool assembly 22*h* in FIGS. 19-22 can be the same as the spa pool assembly 22*g* in FIG. 18 (as further described using the principles in FIGS. 14-16) except for the differences noted below, so the same numeral designations will be used to designate the same elements in FIGS. 19-22 and FIGS. 14-16 and 18, except that an "h" is added to the corresponding elements in FIGS. 19-22.

As with the spa pool 22*g*, the spa pool 22*h* is provided with a multi-sectional base or bottom wall 46*h* that has a plurality of different sections 200*h* that are divided by passages 201*h* and 202*h*. In the embodiment of FIGS. 19-22, there are four sections 200*h* that are divided by two perpendicular passages 201*h*, 202*h* that intersect each other. Each section 200*h* can be inflated separately via valves 208*h*, which can be single or multi-valves. In addition, there is a circumferential passage 204*h* that extends around the edge of the base 46*h* and separates the sections 200*h* from the bottom chamber 34*h*. The passages 202*h* and 204*h* communicate with each other, and are essentially embodied in the form of grooves that are formed between the chamber 34*h* and the sections 200*h*.

An additional passage 203*h* is provided adjacent the passage 204*h*, and communicates with the passage 201*h* via a path (see dotted lines in FIG. 20) underneath the passage 204*h*. The passages 202*h* and 204*h* are small bubble fluid passages, and the passages 201*h* and 203*h* are large bubble fluid passages. Each of these passages 201*h*-204*h* has a top wall, with small bubble openings 197*h* provided in the top wall of the passages 202*h* and 204*h*, and large bubble openings 199*h* provided in the top wall of the passages 201*h* and 203*h*. Large bubbles and fluid are ejected from the large bubble passages 201*h*, 203*h* via the large bubble openings 199*h*, and small bubbles and fluid are ejected from the small bubble passages 202*h*, 204*h* via the small bubble openings 197*h*. The small bubbles are essentially the same as the bubbles ejected in the embodiments of FIGS. 1-18. Optionally, conventional jet nozzles or nozzle assemblies can be installed at one or more, or all of, the large bubble openings 199*h*.

The different passages 201*h*-204*h* allow for circulated fluid and air to be propelled from additional sources towards the people sitting in the pool 22*h*. In particular, the air bubbles from the passages 201*h*-204*h* provide a massage function from the bottom. Also, the provision of different-sized bubble openings 197*h*, 199*h* allow for the user (via the bubble controller 229*h* described below) to vary the types of bubbles being jetted to the user, thereby enhancing the spa experience of the user.

In addition, the pool 22*h* includes ports 80*h* and 82*h* through which water from the interior of the pool 22*h* can be delivered to the control unit (not shown, but can be the same as 28), and from the control unit back to the interior of the pool 22*h*. The pool 22*h* also includes a drain port 222*h* that is aligned with the drain opening (not shown, but can the same as 224) in the liner (not shown in FIGS. 19-22). Water from the interior of the pool 22*h* can be drained via the drain port 222*h* and the drain opening in the liner. A cover (not shown, but can be the same as 25) can be placed over the top of the pool 22*h* and the liner.

Figure 19:
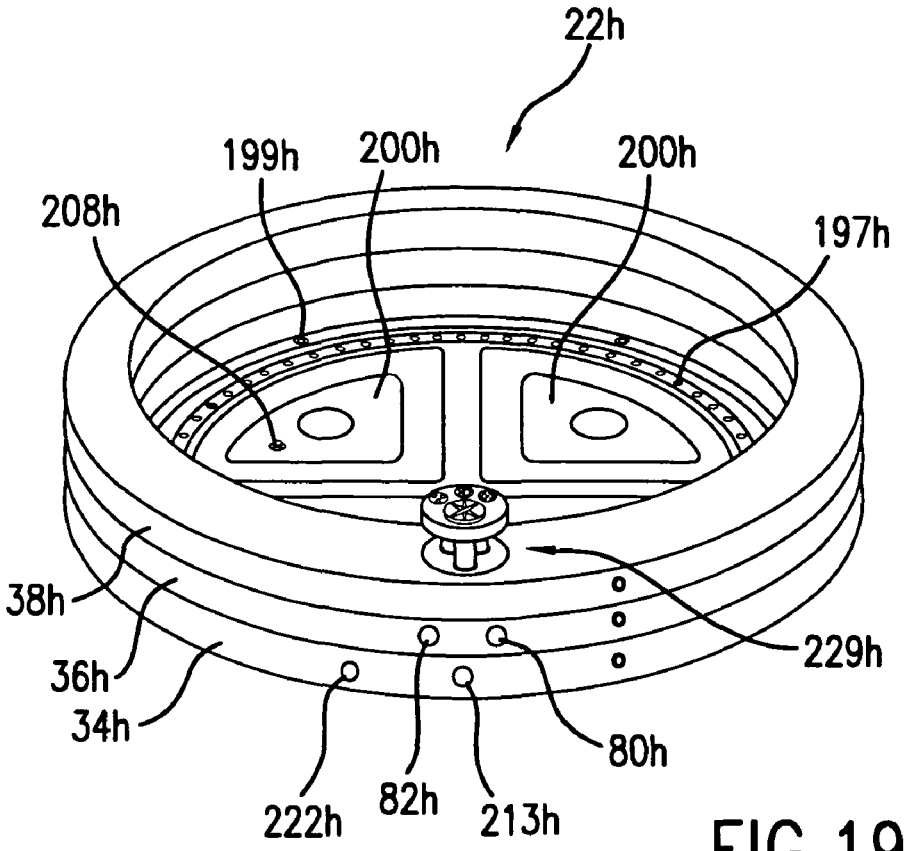
FIG. 19 is an exploded perspective view of a portable spa pool assembly according to yet another embodiment of the present invention.
Figure 21:
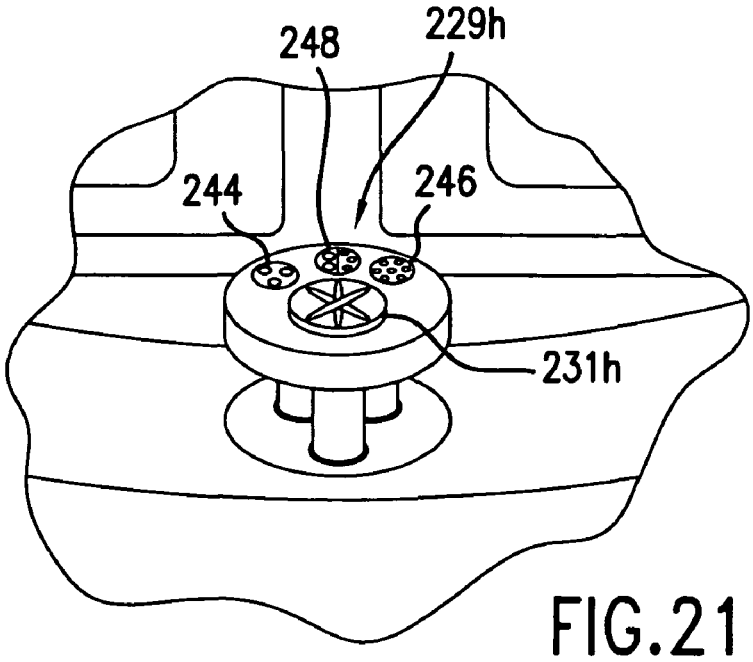
FIG. 21 is an enlarged perspective view of the bubble controller of the portable spa pool assembly of FIG. 19.
Figure 20:
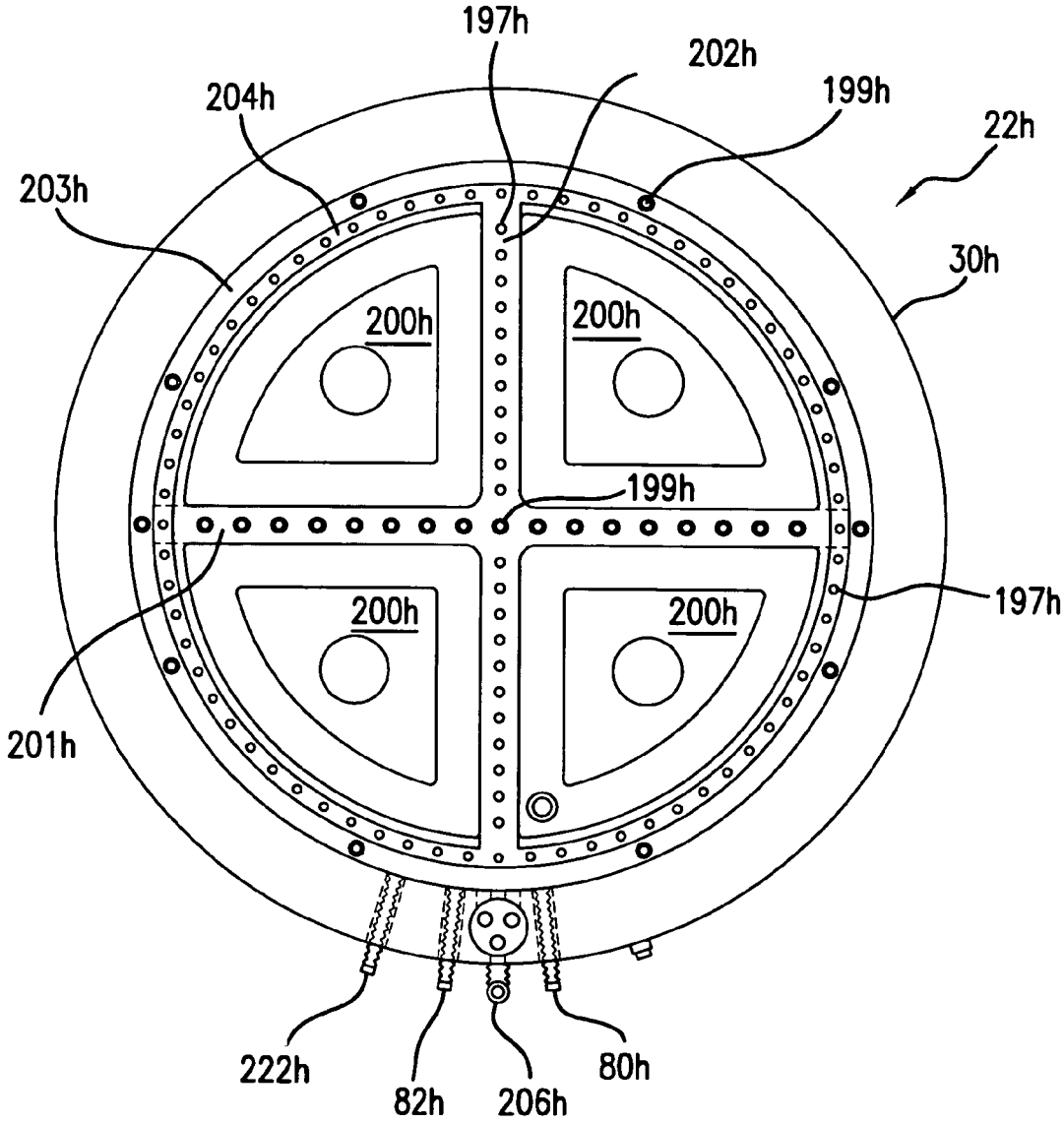
FIG. 20 is a top plan view of the portable spa pool assembly of FIG. 19.
Figure 22:
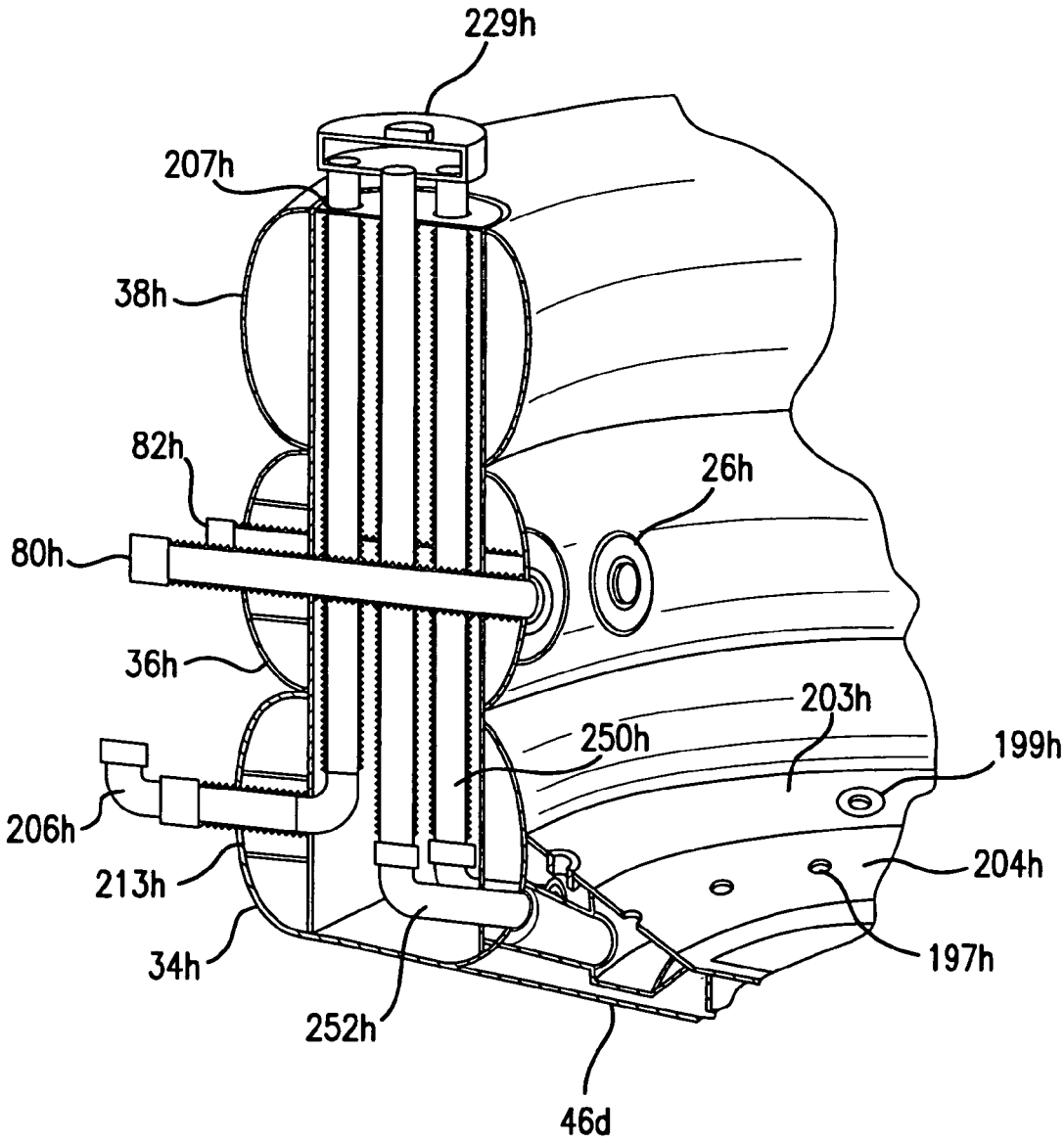
FIG. 22 is an enlarged cross-sectional view of the portable spa pool assembly of FIG. 19.

Referring to FIGS. 19, 21 and 22, a bubble controller 229*h* is provided for allowing the user to select the desired bubble output that is jetted to the user inside the pool 22*h*. The bubble controller 229*h* has a selector dial 231*h* that can be turned to one of a plurality of settings. The embodiment shown in FIGS. 19, 21 and 22 provides for three separate settings, although any number of different settings can be provided. The three settings, each represented by a separate button, are: large bubbles 244 (via the large bubble openings 199*h*), small bubbles 246 (via the small bubble openings 197*h*), and both large and small bubbles 248 (via all the openings 197*h*, 199*h*). The bubble controller 229*h* has a chamber 233*h* which is in fluid communication with the air hose 206*h*, a large bubble hose 250*h*, and a small bubble hose 252*h*, which are described in greater detail below. A dividing wall 235*h* is connected to the dial 231*h*, and is movable within the chamber 233*h* to assume one of three positions, a first position that corresponds to the setting 244, a second position that corresponds to the setting 246, and a third position that corresponds to the setting 248.

As with the spa pool 22*g*, the air hose 206*h* extends through the wall 30*h*. Specifically, the air hose 206*h* has a first end that is connected to an air bubble generator (not shown, but can be the same as 210*d*) at the exterior of the pool 22*h* and extends via an opening 213*h* in the wall 30*h* to the interior of the chambers 34*h*, 36*h*, 38*h*. The air hose 206*h* extends upwardly in the wall 30*h* and exits the top of the chamber 38*h* via an opening 207*h* to the chamber 233*h* inside the bubble controller 229*h*. A large bubble hose 250*h* and a small bubble hose 252*h* extend downwardly from the chamber 233*h* of the bubble controller 229*h* through the wall 30*h*. The large bubble hose 250*h* communicates with the large bubble fluid passage 203*h*, and the small bubble hose 252*h* communicates with the small bubble fluid passage 204*h*. Since the large bubble fluid passage 203*h* is fluidly coupled to the other large bubble fluid passage 201*h*, the fluid and air from the large bubble hose 250*h* can be circulated along the two passages 201*h*, 203*h* and fluid and bubbles ejected at any of the openings 199*h*. Similarly, since the small bubble fluid passage 204*h* is fluidly coupled to the other small bubble fluid passage 202*h*, the air and fluid from the small bubble hose 252*h* can be circulated along the two passages 202*h*, 204*h* and fluid and bubbles ejected at any of the openings 197*h*. The different-sized openings 197*h* and 199*h* allow for the ejection of bubbles of different sizes, thereby allowing the user to adjust the comfort of the spa experience.

Figure 23:
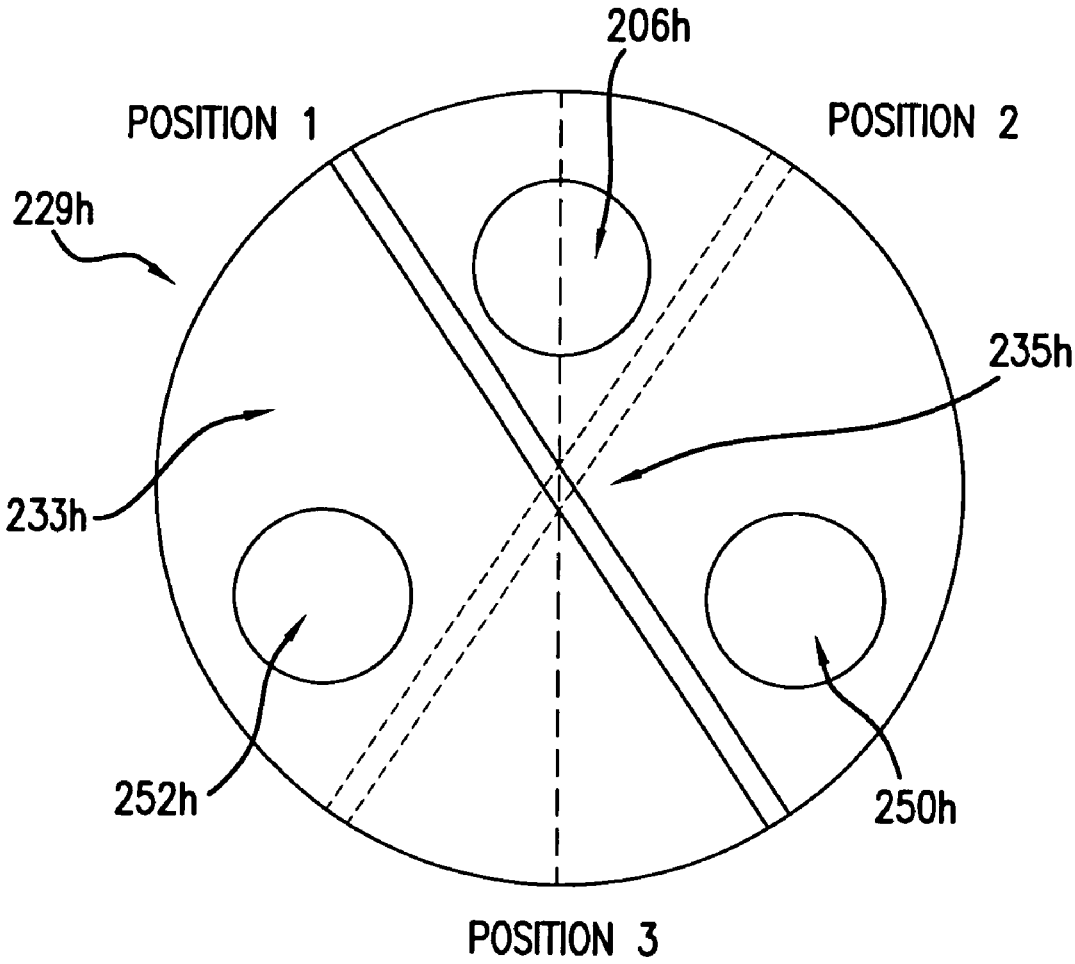
FIG. 23 illustrates the internal components of the bubble controller of FIG. 21.

In use, the air hose 206*h* delivers air to the chamber 233*h*. When the dial 231*h* is turned to the setting 244, the wall 235*h* blocks off the air hose 206*h* from the small bubble hose 252*h* (see FIG. 23) so that the air bubbles and fluid can only travel to the large bubble hose 250*h*. Similarly, when the dial 231*h* is turned to the setting 246, the wall 235*h* blocks off the air hose 206*h* from the large bubble hose 250*h* so that the air bubbles and fluid can only travel to the small bubble hose 252*h*. When the dial 231*h* is turned to the setting 248, the wall 235*h* divides the opening from the air hose 206*h* so that some of the bubbles and fluid travel to the small bubble hose 252*h*, and some of the bubbles and fluid travel to the large bubble hose 250*h*.

The combination of the upward air hose 206*h* and the downward bubble hoses 250*h*, 252*h* provide a U-shaped delivery passage which provides a safety feature over the air hose 206 shown in FIGS. 9-13 in that it can minimize the back flow of water to the air bubble generator when the power is turned off. By providing the U-shaped curve at a vertical level that is higher than the water level in the spa pool 22*h*, any siphoning effect can be avoided when the power is turned off.

Also, even though FIGS. 19-22 only illustrate four passages 201*h*-204*h*, any number of passages (including any number of small bubble passages 202*h*, 204*h* and any number of large bubble passages 201*h*, 203*h*) can be provided as well to vary and enhance the spa experience.

While the description above refers to particular embodiments of the present invention, it will be understood that many modifications may be made without departing from the spirit thereof. The accompanying claims are intended to cover such modifications as would fall within the true scope and spirit of the present invention. For example, each jet nozzle assembly 26 and the control unit 28 can be powered by batteries, so that the wirings 58 and 84 can be omitted.

What is claimed is:

1. A portable spa pool assembly, comprising:

a pool having a planar base and a vertical enclosing wall extending from the base, the base and enclosing wall together defining an interior;

the base having a plurality of inflatable sections that are divided by two perpendicular air passages and surrounded by two concentric rings of air passages;

wherein the two concentric rings of air passages includes an outer air passage ring and an inner air passage ring, with the outer air passage ring having a plurality of large bubble openings and the inner air passage ring having a plurality of small bubble openings;

wherein the two perpendicular air passages includes a first air passage and a second air passage that intersect each other, with the first air passage having a plurality of large bubble openings and the second air passage having a plurality of small bubble openings; and wherein the small bubble openings eject bubbles that are smaller in size than the bubbles ejected from the large bubble openings.

2. The assembly of claim 1, further including a bubble controller that controls the ejection of bubbles from the small bubble openings and the large bubble openings.

3. The assembly of claim 1, wherein the two concentric rings of air passages extend around a periphery of the base.

4. The assembly of claim 1, further including an air hose that delivers air from outside the pool to the air passages, the air hose extending partially inside the enclosing wall and being coupled to a U-shaped section extending outside the enclosing wall at a vertical level that is higher than the top of the enclosing wall.

5. The assembly of claim 4, further including first and second bubble hoses extending inside the enclosing wall and fluidly coupled to the air passages.

6. The assembly of claim 4, further including a bubble controller that controls the ejection of bubbles from the small bubble openings and the large bubble openings, with the bubble controller being part of the U-shaped section.

7. The assembly of claim 1, further including:

a water circulation control unit positioned outside the pool, the control unit having a first tubing coupled to the control unit and extending through the enclosing wall into the interior of the pool, and a second tubing coupled to the control unit and extending through the enclosing wall into the interior of the pool.

8. The assembly of claim 1, wherein the enclosing wall is inflatable.

9. The assembly of claim 5, further including a bubble controller having a chamber to which the air hose, the first bubble hose and the second bubble hose are connected, the bubble controller including a dividing wall that divides the chamber to control the flow of air from the air hose into one or both of the bubble hoses.

10. The assembly of claim 1, wherein the air passages divide the plurality of inflatable sections into four inflatable sections.

11. The assembly of claim 1, wherein the perpendicular air passages intersect at the centers of the air passages.

12. The assembly of claim 2, wherein the bubble controller has a selector dial that is turned to one of three settings, a first setting where only small bubbles are ejected from the small bubble openings, a second setting where only large bubbles are ejected from the large bubble openings, and a third setting where large and small bubbles are ejected.

* * * * *